US006437768B1

(12) United States Patent
Kubota et al.

(10) Patent No.: US 6,437,768 B1
(45) **Date of Patent: *Aug. 20, 2002**

(54) DATA SIGNAL LINE DRIVING CIRCUIT AND IMAGE DISPLAY APPARATUS

(75) Inventors: Yasushi Kubota, Sakurai; Tamotsu Sakai; Ichiro Shiraki, both of Tenri, all of (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/060,732

(22) Filed: Apr. 15, 1998

(30) Foreign Application Priority Data

Apr. 23, 1997 (JP) ..... 9-106272

(51) Int. Cl.[7] ..... G09G 3/36

(52) U.S. Cl. ..... 345/100; 345/98; 345/99; 345/204

(58) Field of Search ..... 345/98, 99, 100, 345/204

(56) References Cited

U.S. PATENT DOCUMENTS 5,103,218 A * 4/1992 Takeda ..... 345/100
5,465,053 A * 11/1995 Edwards ..... 345/93
5,781,171 A * 7/1998 Kihara et al. ..... 345/100
5,870,071 A * 2/1999 Kawahata ..... 345/100
5,889,504 A * 3/1999 Kihara et al. ..... 345/100
5,949,397 A * 9/1999 Koyama et al. ..... 345/98
5,956,011 A * 9/1999 Koyama et al. ..... 345/100
5,977,944 A * 11/1999 Kubota et al. ..... 345/100
6,072,456 A * 6/2000 Karube et al. ..... 345/98
6,144,355 A * 11/2000 Murata et al. ..... 345/99

FOREIGN PATENT DOCUMENTS

JP 63-50717 10/1988
JP 9-182004 7/1997

OTHER PUBLICATIONS

Patent Application Serial No. 08/841,585, Filed Apr. 30, 1997 (copending appln.).

* cited by examiner

*Primary Examiner*—Bipin Shalwala
*Assistant Examiner*—Vincent E. Kovalick
(74) *Attorney, Agent, or Firm*—Edwards & Angell, LLP; David G. Conlin; William J. Daley, Jr.

(57) ABSTRACT

A shift register circuit, composed of a plurality of serially connected latch circuits, for sequentially transmitting a pulse signal in sync with a rising and a falling of a clock signal, and an output circuit for sequentially outputting a video signal to data signal lines in sync with the pulse signal outputted from the shift register circuit are provided. The shift register circuit is divided into a plurality of latch circuit groups, and the stage numbers of the latch circuits in each latch circuit group is set in such a manner to minimize the time difference between the pulse signal outputted from each latch circuit group and the video signal outputted in sync with the pulse signal. Consequently, the power consumption on the clock signal lines can be reduced while the time difference between the clock signal and the video signal can be prevented, thereby making it possible to provide a data signal line driving circuit and an image forming display apparatus which can realize a display of a satisfactory image.

21 Claims, 18 Drawing Sheets

CLK
BLK1
BLK2
BLKn
G1
Gn
CLOCK SIGNAL CONTROL CIRCUIT
CRL1
CRL2
CRLn
1
CKI1
CKI2
CKIn
I1
In
LAT1
LAT1₁
LAT1₂
LAT2₁
LAT2₂
LAT2b
LATn₁
LATn₂
LATnm
ST
LATCH CIRCUIT
BUF1₁
BUF1₂
BUF1a
BUF2₁
BUF2₂
BUF2b
BUFn₁
BUFn₂
BUFnm
BUFFER
V1
Vn
VIDEO
2
ANALOG SWITCH
ASW1₁
ASW1₂
ASW1a
ASW2₁
ASW2₂
ASW2b
ASWn₁
ASWn₂
ASWnm
SL1
SL2
SLj
a < b <----<m

DATA SIGNAL LINE DRIVING CIRCUIT AND IMAGE DISPLAY APPARATUS

FIELD OF THE INVENTION

The present invention relates to a data signal line driving circuit and an image display apparatus having a shift register circuit for transmitting a pulse signal in sync with a clock signal.

BACKGROUND OF THE INVENTION

A liquid crystal display device adopting an active matrix driving method has been known as an example image display apparatus. The liquid crystal display device adopting the above driving method is composed of a pixel array, a data signal line driving circuit, and a scanning signal line driving circuit.

A plurality of scanning signal lines and a plurality of data signal lines are provided in the pixel array to cross each other, and a pixel is provided to each area enclosed by two adjacent scanning signal lines and two adjacent data signal lines, thereby forming a matrix arrangement.

Each pixel is composed of, for example, an electric field effect transistor serving as a switching element, a liquid crystal capacitance, and an auxiliary capacitance. An image is displayed as transmittance of the liquid crystal in each pixel varies with the ON/OFF action of the electric field effect transistor at the timing of a signal supplied to the scanning signal lines, while a voltage is applied to the liquid crystal capacitance and auxiliary capacitance by a signal supplied to the data signal lines.

Incidentally, a conventional active matrix liquid crystal display device generally uses an amorphous silicon thin film formed over a transparent substrate as a substrate material for a pixel transistor, and the data signal line driving circuit and scanning signal line driving circuit are composed of outboard ICs.

In contrast, to meet an increasing demand for an upgraded drivability of the pixel transistor for a larger-scale screen, cost reduction for the driving IC packaging, or packaging reliability, there has been proposed a display apparatus in which the pixel array and driving circuits are formed monlithically out of a polycrystalline silicon thin film. To further upsize the screen and reduce the costs, it is also Proposed to make elements out of the polycrystalline silicon thin film formed over the glass substrate at a process temperature up to the glass distortion point (about 600° C.).

An example liquid crystal display device of the above monolithic structure includes a dielectric substrate having thereon formed the pixel array, data signal line driving circuit, and scanning signal line driving circuit.

Incidentally, the data signal line driving circuit has two driving methods: a dot sequential driving method and a line sequential driving method, and what distinguishes one method from the other is how a video signal is written into the data signal lines.

For example, as shown in FIG. 15, a data signal line driving circuit 122 adopting the dot sequential driving method is composed of a plurality of serially connected latch circuits LTi (i=1, 2, . . . , m), buffers BFi (i=1, 2, . . . , m) respectively connected to the output terminals of the latch circuits LTi, and analog switches ASi (i=1, 2, . . . , m) for sampling a data signal DAT from a video signal line.

The data signal DAT is inputted into the above-arranged data signal line driving circuit 122 through the video signal line as a video signal. Then, in the data signal line driving circuit 122, each analog switch ASi is opened/closed in sync with a pulse signal outputted from the corresponding latch circuit LTi through the corresponding buffer BFi in sync with a clock signal CK and a start signal SP, whereby the data signal DAT supplied from the video signal line is sampled and written into the corresponding data signal line SLi (i=1, 2, . . . ,m).

Also, as shown in FIG. 16, in a scanning signal line driving circuit 123, the output terminals of latch circuits LTj (j=1, 2, . . . , n) are respectively connected to buffers BFj (j=1, 2, . . . , n), the output terminals of the buffers BFj are respectively connected to logic circuits LGj (j=1, 2, . . . , n), and the output terminals of the logic circuits LGj are respectively connected to the buffers BFj.

Each logic circuit LGj receives a pulse signal GPS from a pulse signal line and a pulse signal outputted from the corresponding latch circuit LTj through the corresponding buffer BFj, and performs a logical operation using these two signals. Then, each logic circuit LGj outputs the operation result to a corresponding scanning signal line GLj (j=1, 2, . . . , n) as a control signal for determining whether the data signal DAT from the data signal line driving circuit 122 should be sampled or not.

As has been explained, both the data signal line driving circuit 122 and scanning signal line driving circuit 123 use the scanning circuit for sequentially transmitting the pulse signal in sync with the clock signal. A shift register circuit, a decoder circuit and the like can be used as the scanning circuit. However, the shift register circuit is generally used because it has fewer input terminals and a smaller circuit size (fewer transistors).

The shift register circuit is composed of, for example, two clocked inverters and one inverter. The two clocked inverters receive an antiphase clock signal.

Incidentally, in the scanning circuit used in each driving circuit, only one pulse signal is scanned normally, and the power consumption for transmitting the pulse signal is small.

However, in case of an image display apparatus whose scanning circuit is composed of a shift register circuit having a great number of stages, for example, in case of an image display apparatus using a VGA (Video Graphics Array) panel, the data signal line driving circuit and scanning signal line driving circuit demand a 640-stage shift register circuit and a 480-stage shift register circuit, respectively. Further, in case of an image display apparatus using an XGA (Extended Video Graphics Array) panel, the data signal line driving circuit and scanning signal line driving circuit demand a 1024-stage shift register circuit and a 768-stage register circuit, respectively.

Thus, when the scanning circuit is used for the driving circuit that drives the VGA panel or XGA panel, a sum of an input capacitance from a clock signal line of each clocked inverter in the shift register circuit becomes so large that it accounts for most of the consumed power.

Particularly, when the scanning circuit is composed of the polycrystalline silicon thin film transistor as previously mentioned, the performance (carrier mobility, threshold voltage, element voltage withstand, etc.) of the transistor is inferior to the performance of the transistor formed on a monocrystal silicon substrate, provided that both are of the same size. Thus, to improve the performance of the polycrystalline silicon thin film transistor to the same level as the performance of the transistor formed on the monocrystal silicon substrate, the element size (channel length and channel width) must be increased than the transistors on the monocrystal silicon substrate, and a high driving voltage must be supplied. Therefore, the power consumed on the clock signal line increases remarkably.

To solve the above problem, an example liquid crystal display device adopting the dot sequential driving method as shown in FIG. 17 is disclosed in, for example, Japanese Examined Patent Publication No. 50717/1988 (Tokukoushou No. 63-50717). To be more specific, the shift register circuit in the data signal line driving circuit is divided into a plurality of blocks, and the blocks are sequentially selected at regular time intervals, one at each interval, so that a clock signal CLK is supplied to the latch circuits in the selected block alone.

The above arrangement seems effective to reduce power consumption on the clock signal line if an adequate measure is taken to transmit the pulse signal among the blocks normally. Because the clock signal is selectively transmitted only to the block including latch circuits near the latch circuit to which the pulse signal is transmitted, the number of the latch circuits receiving the clock signal simultaneously is reduced, thereby saving the power consumed to drive a parasitic capacitance (an input gate capacitance of the shift register circuit, a wire capacitance, etc.) of the clock signal line (an internal clock signal line connected to a signal input section of each block inside the shift register circuit) remarkably.

However, according to the arrangement disclosed in the above publication, the timing between the video signal and clock signal may possibly be shifted from each other (time difference may be generated).

In other words, in the above-arranged data signal line driving circuit, the shift register circuit is divided into a plurality of blocks each composed of a certain number of latch circuits, and the blocks are selected sequentially at regular time intervals, one at each interval, so that the clock signal is supplied to the selected block alone. Therefore, a load applied on the clock signal line from the external is so small that the clock signal line hardly causes a delay between the first block (the closest block to the signal input section) and the last block (the remotest block from the signal input section).

In contrast, the video signal line is not divided at all, and is connected to a plurality of analog switches ASW serving as sampling switches. Thus, the load applied thereon is large enough to cause a delay between the first video signal (the closest to the signal input section) and the last video signal (the remotest from the signal input section).

FIG. 18 shows the waveforms of an external clock signal at the points G1 and Gn on an external clock signal line, the waveforms of a n internal clock signal at the points I1 and In on an internal clock signal line, and the waveforms of the video signal at the points V1 and Vn on the video signal line, which respectively correspond to a clock signal control circuit CRL1 in the first stage and a clock signal control circuit CRLn in the last stage in the data signal line driving circuit of FIG. 17. In other words, FIG. 18 shows a comparison result of the waveform of an external clock signal CLK, the waveform of an internal clock signal CKI outputted from the clock signal control circuit CRL, and the waveform of a video signal VIDEO transmitted as the data signal.

In the drawing, CKG1 indicates the waveform at the point G1 on the external clock signal line; CKI1 indicates the waveform at the point I1 on the internal clock signal line; CKGn indicates the waveform at the point Gn on the external clock signal line; CKIn indicates the waveform at the point In on the internal clock signal line; V1 indicates the waveform at the point V1 on the video signal line; and Vn indicates the waveform at the point Vn on the video signal line.

It is apparent from FIG. 18 that in the remote blocks from the signal input section, the delay is larger in the video signal than in the clock signal. The comparison between the waveform at the point In on the internal clock signal line and the waveform at the point vn on the video signal line reveals that their rising timings shift from each other. Thus, in the remote block from the signal input section, if the video signal is sampled based on the clock signal, the reproduced video causes unwanted blur or ghost, thereby making it impossible to obtain a normal video.

SUMMARY OF THE INVENTION

It is therefore an object of the present invention to provide a data signal line driving circuit which can reduce the power consumption on the clock signal line and prevent the time difference (shift in timing) between the clock signal and data signal. Also, it is another object of the present invention to provide an image display apparatus which consumes less power and can display a satisfactory image by employing the above data signal line driving circuit.

To fulfill the above objects, a data signal line driving circuit of the present invention comprises:

a shift register circuit, composed of a plurality of serially connected latch circuits, for sequentially transmitting a pulse signal in sync with a clock signal; and an output circuit for sequentially outputting data signals to data signal lines in sync with output signals outputted from the shift register circuit, and the above data signal line driving circuit is characterized in that:

the shift register circuit is divided into a plurality of blocks; and stage numbers of the latch circuits in each block is set in such a manner to minimize time difference between the output signals outputted from each block and the data signal.

According to the above arrangement, unlike the conventional data signal line driving circuit, the stage numbers of the latch circuits included in each block is set in such a manner to minimize time difference between an output signal outputted from each block and the data signal. For example, when the output circuit includes an analog switch for outputting the data signal inputted from an external, the shift register circuit is arranged in such a manner that the stage numbers of the latch circuits in each block is increased monotonously with a distance from the signal input side. Accordingly, the time difference between the output signal and the data signal is minimized. Consequently, a satisfactory video can be displayed without unwanted blur or ghost caused by the above shift.

In addition, in the above arrangement, the clock signal can be supplied to each block. However, it is preferable to provide a control section for controlling the supply of the clock signal to each block, so that each block has a supply period during which the clock signal is supplied and a non-supply period during which the clock signal is not supplied. However, the supply period is set to cover at least an interval during which any of the latch circuits in its own block transmits the pulse signal.

According to the above arrangement, no clock signal is supplied to each block during the non-supply period while the pulse signal is not transmitted. Thus, the number of the latch circuits receiving the clock signal simultaneously can be reduced. Consequently, the power consumed for driving the internal clock signal lines connected to the input section inside the shift register circuit can be reduced significantly. Hence, the power consumption of the data signal line driving circuit can reduced.

Here, the power consumption of the data signal line driving circuit can be reduced to some extent if the non-supply period is provided to each block regardless of the arrangement of the non-supply period. However, to reduce the power consumption, it is preferable that the clock signal is selectively supplied only to the block including latch circuits near the latch circuit to which the pulse signal is transmitted, for example, a block including the latch circuit to which the pulse signal is transmitted and some latch circuits in the preceding stages. According to the above arrangement, the number of the latch circuits receiving the clock signal simultaneously can be minimized without causing any trouble in the shift register circuit. Consequently, the power consumption of the data signal line driving circuit can be reduced further.

Also, when the clock signal is selectively supplied, the supply period for each block may overlap or may be separated. However, when the supply period for each block do not overlap at all, either the rising or falling edge of the transmission signal can not be transmitted.

Thus, a generating circuit for generating the non-transmitted edge based on the transmitted other edge must be provided additionally, thereby upsizing the data signal line driving circuit.

Thus, it is more preferable to control the supply of the clock signals in such a manner that the clock signals respectively inputted into the latch circuits in the adjacent blocks are supplied to overlap one on the other More specifically, it is preferable to supply the clock signals in such a manner that they overlap one on the other for at least as long as the pulse width of the pulse signal, for example, at least one clock. According to the above arrangement, the pulse signal can be transferred normally between the adjacent blocks. Thus, since an erroneous output of the pulse signal to the latch circuit can be eliminated, the shift register circuit can operate normally, thereby realizing satisfactory video display.

The clock signal may be supplied selectively from the external, but it is preferable to further arrange that a clock signal control circuit for outputting the clock signal to the latch circuits in the block of the shift register circuit for a certain period is provided to each block, and that the clock signal control circuit controls the output of the clock signal based on the output signal from the latch circuits in the preceding and next following blocks.

According to the above arrangement, an additional circuit for controlling the start and end of the output of the clock signal does not have to be provided, because the output of the clock signal is started using the output signal from the latch circuit in the preceding block to the selected block, and the output of the clock signal is stopped using the output signal of the latch circuit in the next following block of the selected block.

Consequently, there can be attained an effect that a circuit added to the data signal line driving circuit can be very small. Moreover, since a control signal for selecting the block is generated inside the data signal line driving circuit, an external terminal for receiving the control signal for selecting the block can be omitted, thereby simplifying the circuit arrangement.

Incidentally, the above-arranged data signal line driving circuit consumes less power and can prevent the time difference between the clock signal and data signal even when a great number of data signal lines are used.

Thus, the above-arranged data signal line driving circuit can be applied to various kinds of apparatuses. Of all the applicable apparatuses, the most preferred example would be an image display apparatus.

To be more specific, the image display apparatus includes a great number of data signal lines and unwanted blur or ghost caused by the time difference readily occurs in the video. However, if the above-arranged data signal line driving circuit is employed as a data signal line driving circuit, the resulting image display apparatus can display a satisfactory image while consuming less power.

For a fuller understanding of the nature and advantages of the invention, reference should be made to the ensuing detailed description taken in conjunction with the accompanying drawings.

DESCRIPTION OF THE EMBODIMENTS

Embodiment 1

Referring to FIGS. 1 through 10, the following description will describe an example embodiment of the present invention. In the present embodiment, a data signal line driving circuit adopting the dot sequential driving method as a method of writing a data signal into a data signal line will be explained.

Figure 1:
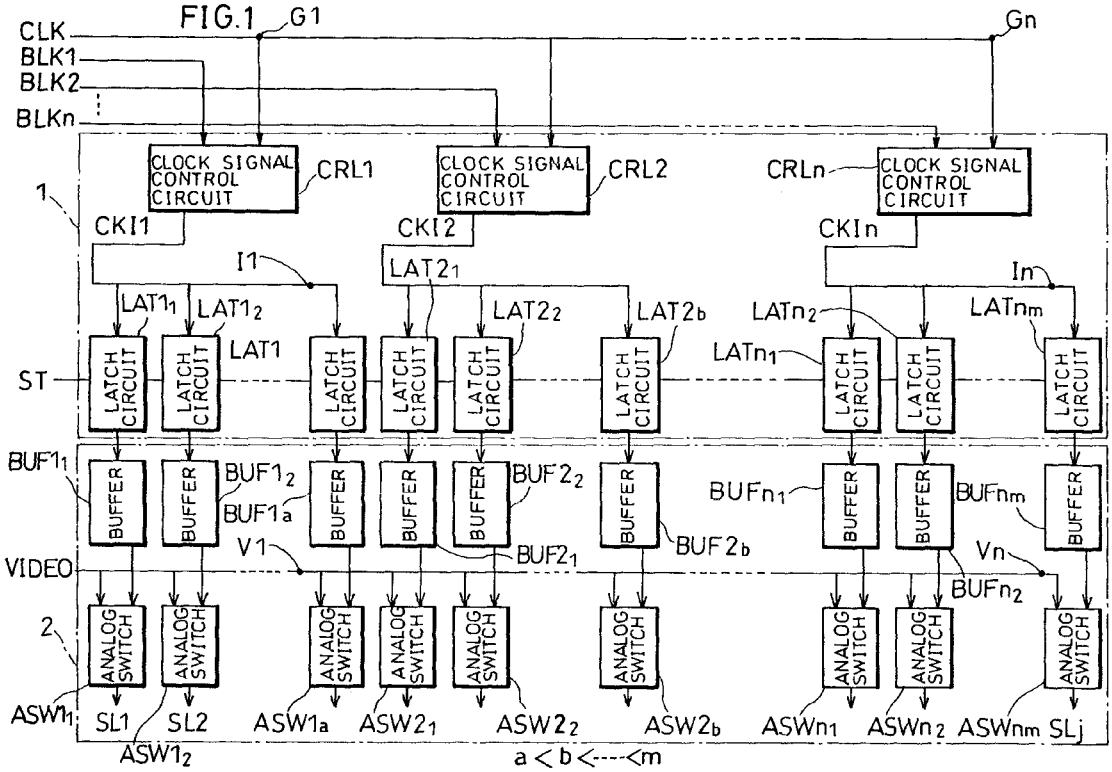
FIG. 1 is a block diagram schematically showing an arrangement of a data signal line driving circuit of the present invention.

As shown in FIG. 1, the data signal line driving circuit in accordance with the present embodiment comprises a shift register circuit 1 composed of a plurality of clock signal control circuits (control section) CRL and a plurality of latch circuits LAT, and an output circuit 2 composed of a plurality of buffers BUF and a plurality of analog switches ASW.

In the above data signal line driving circuit, each analog switch ASW samples a video signal VIDEO transmitted as a data signal in sync with an output pulse from the corresponding latch circuit LAT, and outputs the same to a corresponding data signal line SL.

In the following, for the explanation's conveniences, numerical subscripts representing particular blocks or stages are attached to the clock signal control circuits CRL, latch circuits LAT, buffers BUF, and analog switches ASW at the end of each reference code, and the numerical subscripts are omitted when the blocks or stages do not have to be specified. Note that, however, in the present embodiment, numerical subscripts are attached to each circuit in the drawings.

Figure 2:
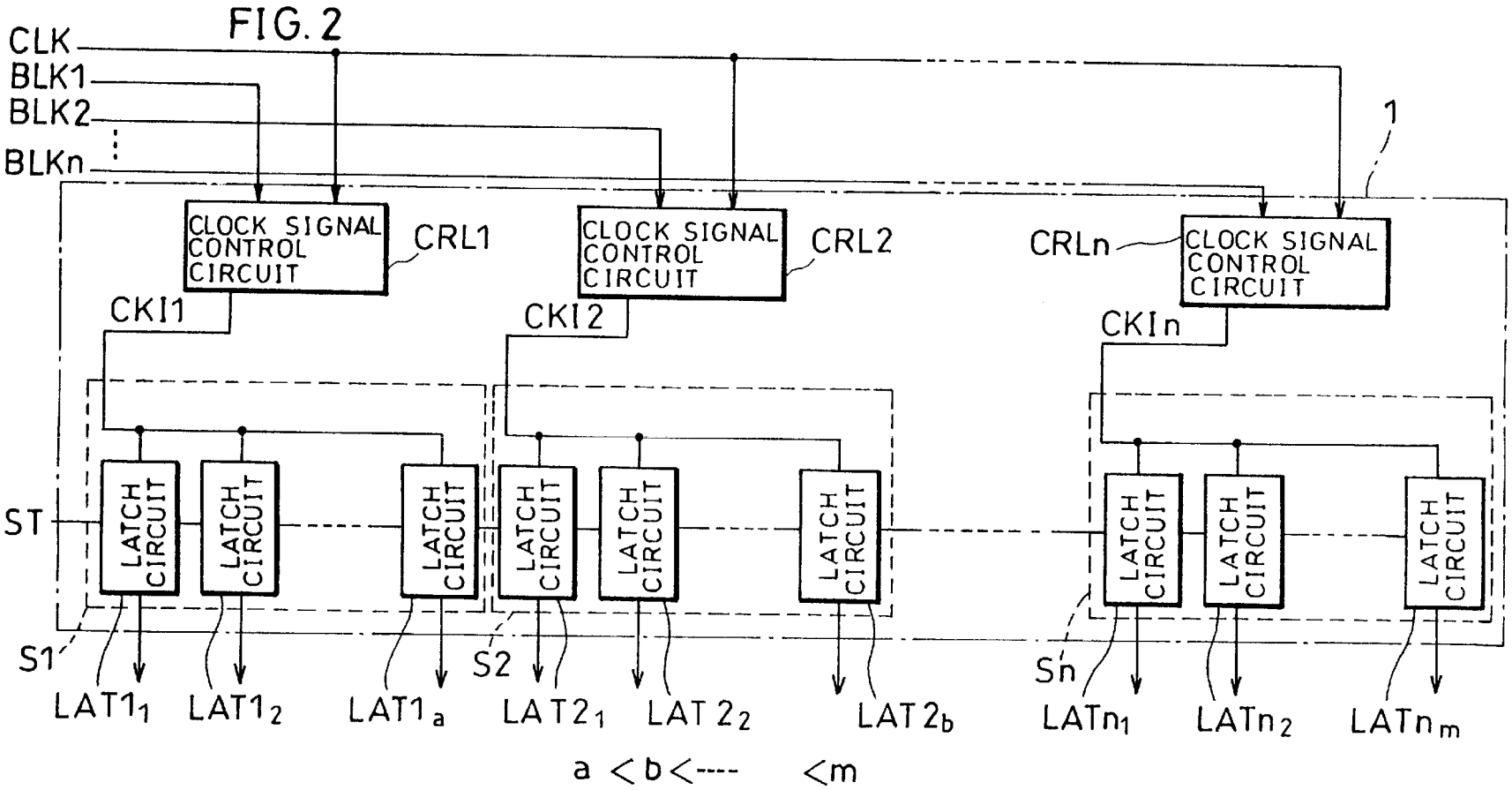
FIG. 2 is a block diagram schematically showing a shift register circuit provided to the data signal line driving circuit of FIG. 1.

As shown in FIG. 2, the latch circuits LAT are connected in series, and divided into n latch circuit groups (blocks) S, each having arbitrary stage numbers. The clock signal control circuits CRL are provided in the matching numbers with the latch circuit groups, that is, n clock signal control circuits CRL are provided. In the following, when a particular clock signal control circuit CRL is specified, a numerical subscript i (i=1, 2, . . . , n) is attached at the end of the reference code CRL. Here, the numerical subscript i is the same as a numerical subscript i (i=1, 2, . . . , n) attached to the latch circuit group S which is placed under the control of the corresponding clock signal control circuit CRL.

Each clock signal control circuit CRL receives an external clock signal CLK and a block selection signal BLK for enabling the clock signal control circuit CRL to select a particular latch circuit group S from which the external clock signal is supplied under control. Then, each clock signal control circuit CRL selectively outputs the external clock signal CLK as an internal clock signal CKI for the corresponding latch circuit group S based on the block selection signal BLK.

As has been explained, each latch circuit group S receives the corresponding internal clock signal CKI. More specifically, the latch circuit group S1 receives the internal clock signal CKI1 under the control of the clock signal control circuit CRL1, the latch circuit group S2 receives the internal clock signal CKI2 under the control of the clock signal control circuit CRL2, and the latch circuit group Sn receives the internal clock signal CKIn under the control of the clock signal control circuit CRLn.

Each latch circuit group Si is arranged in such a manner that the output from the latch circuit $LAT(i-1)_z$ in the last stage of the preceding latch circuit group S(i−1) is inputted into the latch circuit $LATi_1$ in the first stage of the latch circuit group Si. The first latch circuit $LAT1_1$ of the first latch group Si is arranged to receive a pulse of a start signal ST.

Accordingly, the start signal ST, which is in effect a pulse signal, is transmitted throughout the first latch circuit group S1, that is, from the latch circuit $LAT1_1$ to the latch circuit $LAT1_a$, in sync with the internal clock signal CKI1 inputted to the same, and the output signals from the latch circuits $LATi_1$ through $LATi_z$ are outputted to the output circuit 2 (FIG. 1). In each of the succeeding latch circuit groups Si, the signal transmitted from the preceding latch circuit group Si−1 is transmitted from the latch circuit $LATi_1$ to the latch circuit $LATi_z$ in sync with the internal clock signal CKIi, and the output signals from the latch circuits $LATi_1$ through $LATi_z$ are outputted to the output circuit 2. Each latch circuit group Si is not activated unless it receives the aforementioned internal clock signal CKIi (i=1, 2, . . . , n).

Figure 3:
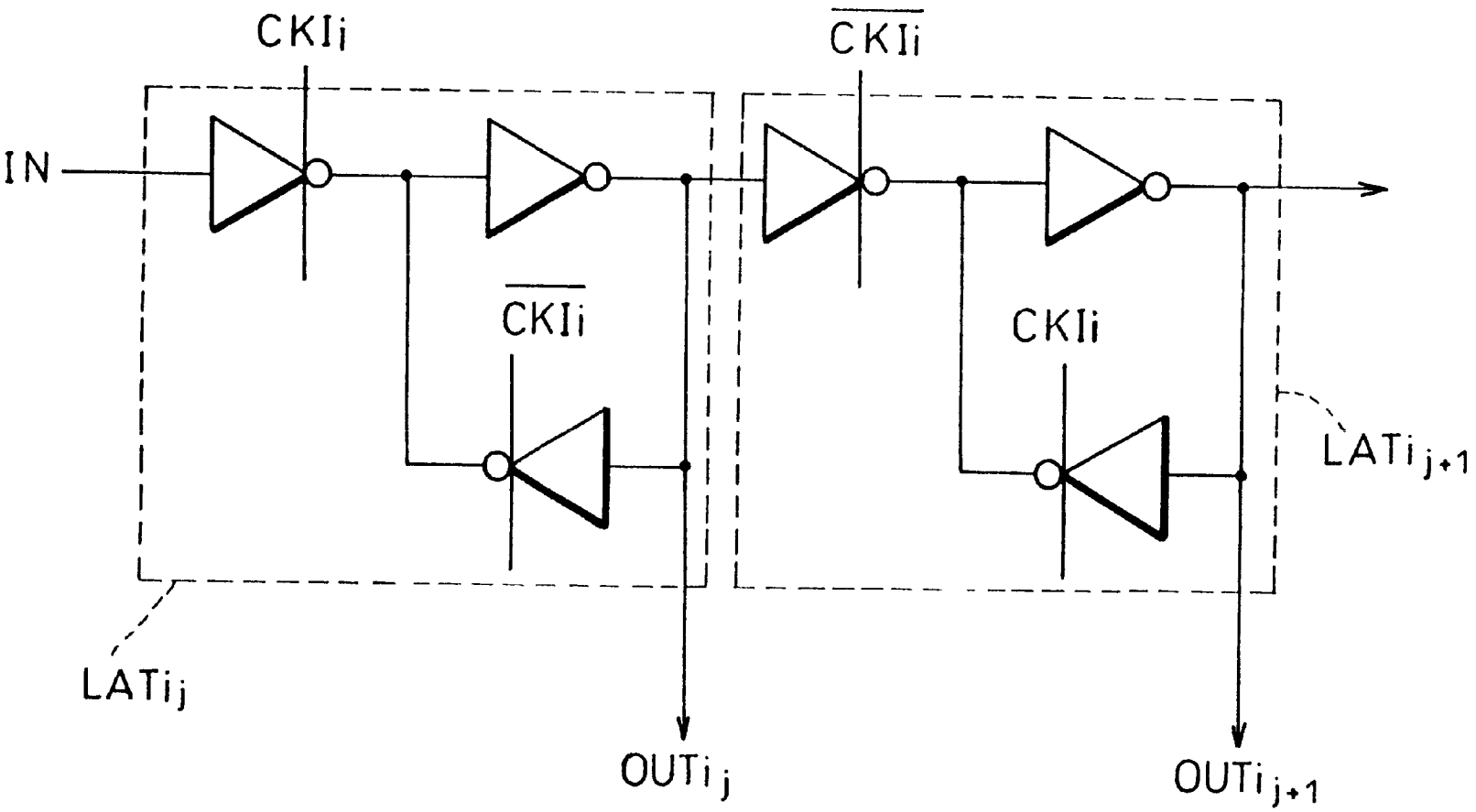
FIG. 3 is a block diagram schematically showing an arrangement of latch circuits forming the shift register circuit of FIG. 2.

An arrangement of the latch circuits LAT will be explained in detail with reference to FIG. 3. In the drawing, the latch circuits $LATi_j$ and $LATi_{j+1}$. in two stages within one latch circuit group Si are illustrated.

Each latch circuit LAT is composed of two clocked inverters and one inverter. The two clocked inverters receive the antiphase internal clock signal CKIi generated by the clock signal control circuit CRLi (FIG. 2).

More specifically, the latch circuit $LATi_j$ in the signal input terminal (IN) side transmits a signal inputted through the IN terminal to the latch circuit $LATi_{j+1}$ in the following stage in sync with the internal clock signal CKIi and an inverted signal $\overline{CKIi}$ inputted thereto, while outputting the same to an $OUTi_j$ terminal. Then, the latch circuit $LATi_{j+1}$ in the following stage transmits the signal outputted from the latch circuit $LATi_j$ in the preceding stage to the latch circuit $LATi_{j+2}$ in the following stage (not shown) in sync with the internal clock signal CKIi and an inverted signal $\overline{CKIi}$ inputted thereto, while outputting the same to the $OUTi_{j+1}$ terminal.

The stage numbers of the latch circuits LAT in each latch circuit group S is set in such a manner to minimize the time difference between (the timing of) the output signal from the latch circuit group S and (the ideal timing of) another signal outputted from the output circuit 2, such as a data signal. In other words, the stage numbers of the latch circuits LAT is set differently in each latch circuit group S.

In the present embodiment, the stage numbers of the latch circuits LAT in the latch circuit groups S increases monotonously with a distance from the input side of the video signal VIDEO, which is inputted into the output circuit 2 as the data signal. To be more specific, the stage numbers in the latch circuits groups S1, S2, and Sn are set to a, b, and m, where a<b< . . . <m. In FIGS. 1 and 2, the inverted signals of the external clock signal CLK and internal clock signal CKI are omitted.

As shown in FIG. 1, the output circuit 2 includes the buffers BUF and analog switches ASW in a corresponding manner to the latch circuits LAT in the latch circuit groups S in the shift register circuit 1. In short, one buffer BUF and one analog switch ASW are provided for each latch circuit LAT.

Figure 4:
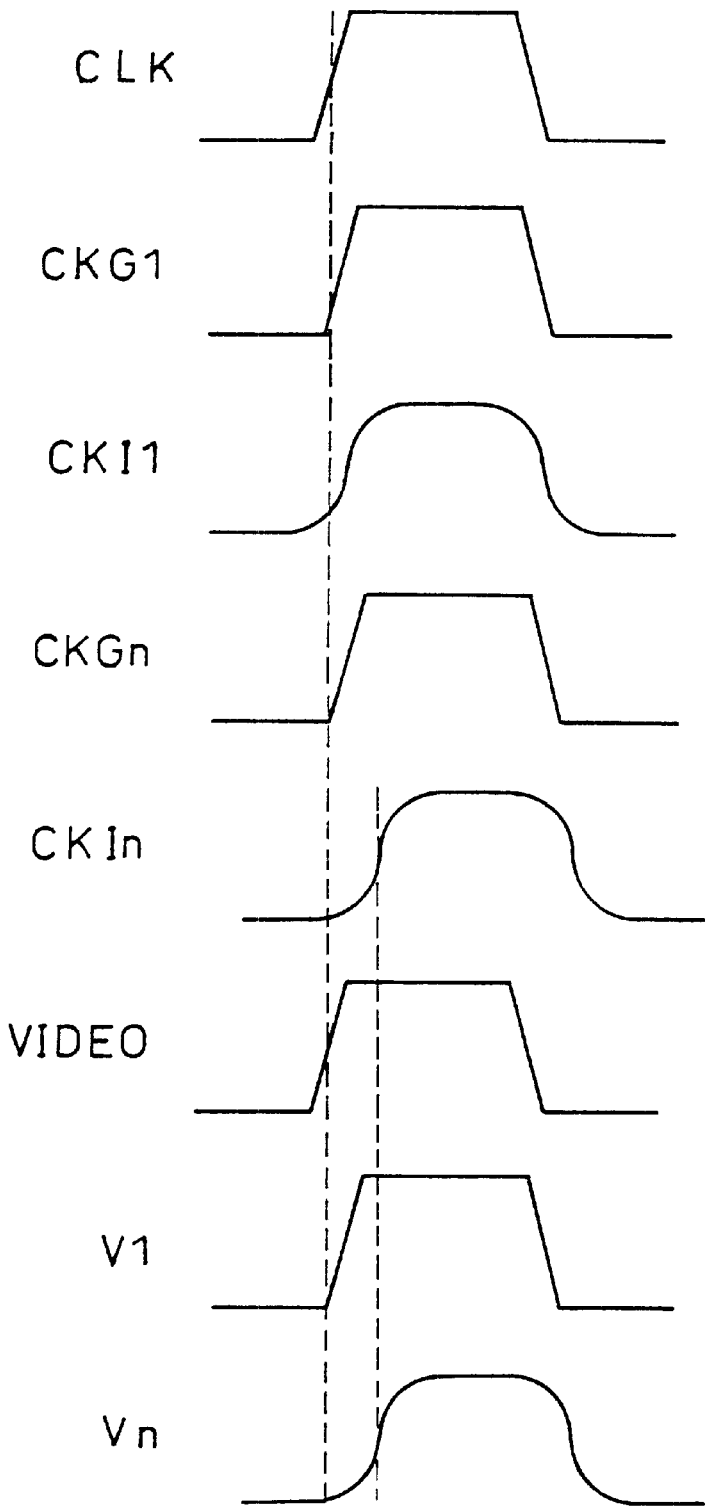
FIG. 4 is a view showing the waveform of each signal at arbitrary points in the data signal line driving circuit of FIG. 1.

FIG. 4 shows the waveforms of the external clock signal at the points G1 and Gn on the external clock signal line, the waveforms of the internal clock signal at the points I1 and In on the internal clock signal line, and the waveforms of the video signal at the point V1 and Vn on the video signal line, which respectively correspond to the clock signal control circuit CRL1 in the first stage and the clock signal control circuit CRLn in the last stage in the above-arranged data signal line driving circuit. In other words, FIG. 4 shows the comparison result of the waveform of the external clock signal CLK, the waveform of the internal clock signal CKI outputted from the clock signal control circuit CRL, and the waveform of the video signal VIDEO transmitted as the data signal.

In the drawing, CKG1 represents the waveform at the point G1 on the external clock signal line; CKI1 represents the waveform at the point I1 on the internal clock signal line; CKGn represents the waveform at the point Gn on the external clock signal line; CKIn represents the waveform at the point In on the internal clock signal line; V1 represents the waveform at the point V1 on the video signal line; and Vn represents the waveform at the point Vn on the video signal line.

It is apparent from FIG. 4, that the comparison between the waveform at the point In on the internal clock signal line and the waveform at the point Vn on the video signal line in FIG. 4 reveals that their rising timings match with each other almost perfectly. This can be realized by adjusting the stage numbers of the latch circuits LAT included in each latch circuit group S in the data signal line driving circuit.

In the present embodiment, the rising timing in the waveform at the point In on the internal clock signal line and rising timing in the waveform at the point Vn on the video signal line are matched almost perfectly by monotonously increasing the stage numbers of the latch circuits LAT in the latch circuit groups S with a distance from the input side of the video signal VIDEO.

The following description explains the reason why the rising timings in the waveform at the point In on the internal clock signal line and in the waveform at the point Vn on the video signal line can be matched almost perfectly by gradually increasing the number of the latch circuits LAT, that is, the stage numbers of thereof, in the latch circuit groups Si forming the shift register circuit 1 with a distance from the video signal input side.

In the first place, a delay of the clock signal in the data signal line driving circuit of FIG. 1 will be explained.

Since the external clock signal CLK is inputted into the n clock signal control circuits CRL alone, the load of the signal line conveying the eternal clock signal CLK is relatively small. Hence, the external clock signal line hardly causes a delay. More specifically, as shown in FIG. 4, a delay between the signals CKG1 and CKGn in response to the external clock signal CLK is very small.

On the other hand, a signal line for supplying the internal clock signal CKI is connected to a plurality of the latch circuits in one group. Hence, the load of the signal line is far larger than the load of the external clock signal line. Accordingly, a delay of the internal clock signal increases with the number of the latch circuits LAT in the latch circuit group S. In other words, as shown in FIG. 4, a delay between the internal clock signal CKI1 corresponding to the signal CKG1 inputted into the latch circuit group S1 and the internal clock signal CKIn corresponding to the signal CKGn inputted into the latch circuit group Sn is large.

However, since output resistance of the clock signal control circuit CRL is larger than wire resistance of the signal line for transmitting the internal clock signal CKI, a delay difference of the internal clock signal CKI within the latch circuit group S is small.

Next, a delay of the video signal VIDEO, .which is in effect the data signal, in the data signal line driving circuit of FIG. 1 will be explained.

The video signal line is not divided at all and is connected directly to a plurality of the analog switches ASW. Hence, the load of the video signal line is remarkably large, and so is the delay. More specifically, as shown in FIG. 4, a delay between the video signal V1 in the first latch circuit group S1 and the video signal Vn in the last latch circuit group Sn is very large.

Generally, a delay of the video signal tends to be larger than a delay of the internal clock signal with a distance from the input side. In other words, a delay of the internal clock signal CKI can be increased gradually to become as large as a delay of the video signal by increasing the number of the latch circuits LAT, that is, the stage numbers thereof, in the latch circuit groups S with a distance from the input side.

Thus, when the stage numbers in each latch circuit group S is set as explained above, the timing of rising or falling of the internal clock signal CKI and video signal (the timings of CKI1 and V1, and the timings of CKIn and Vn in FIG. 4) can be matched with each other.

Accordingly, since the video signal is sampled at normal timing, satisfactory video display without unwanted blur or ghost caused by the shift of the timings at the rising or falling (time difference) between the internal clock signal and video signal can be realized.

Figure 5:
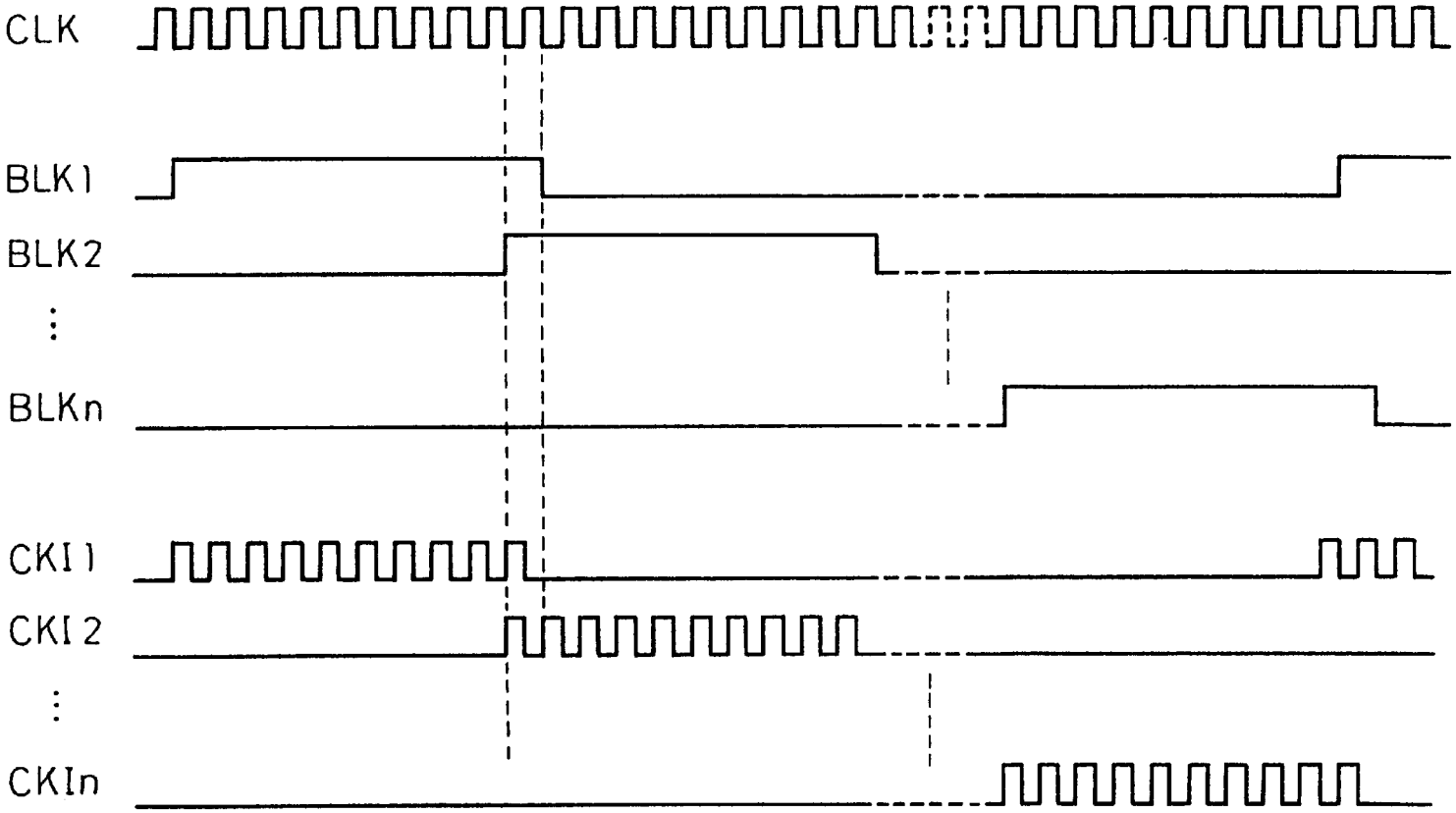
FIG. 5 is a view showing the waveform of each signal in the data signal line driving circuit of FIG. 1.

The correlation among the waveforms of the external clock signal CLK, block selection signal BLKi (i=1, 2, . . . , n), and internal clock signal CKIi (i=1, 2, . . . , n) in the above-arranged data signal line driving circuit will be explained with reference to the waveforms in FIG. 5.

The block selection signal BLKi is outputted in such a manner that it stays at the high level (hereinafter, referred to as active state) for at least as long as a scanning time of each latch circuit group Si (that is, a period corresponding to the stage numbers of the latch circuits LAT). Accordingly, the clock signal control circuit CRLi supplies the external clock signal CLK as the internal clock signal CKIi to the latch circuit group Si corresponding to the block selection signal BLKi when the block selection signal BLKi is in the active state.

Also, the block selection signal BLKi is inputted into the clock signal control circuit CRLi in such a manner that the internal clock signal CKIi supplied to the corresponding latch circuit group Si overlaps the internal clock signal CKIi+1 supplied to the block Bi+1 adjacent to the above particular latch circuit group Si for at least 1 clock. For example, as shown in FIG. 5, the block selection signal BLK1 overlaps the block selection signal BLK2 for one clock of the external clock signal CLK. Accordingly, the internal clock signal CKI1 overlaps the internal clock signal CKI2 for one clock.

The overlap width of the internal clock signals CKI must be at least as wide as the pulse width of a transmission signal to transmit the pulse signal normally throughout the shift register circuit 1, and the overlap for one clock is sufficient for a typical latch circuit LAT. However, when a signal with a wider pulse width is transmitted, the overlap width is extended in an adequate manner. For example, when a signal having a pulse with of three clocks is transmitted, an overlap width of at least three clocks is necessary.

In contrast, if the internal clock signals CKI do not overlap at all, only one of the rising and falling of the signal is transmitted. In this case, an additional circuit for generating the edge of either the rising or falling based on the other successfully transmitted edge is demanded to control the opening/closing of the analog switches ASW, thereby undesirably upsizing the data signal line driving circuit as a whole.

However, when the internal clock signal CKIi supplied to the latch circuit group Si from the clock signal control circuit CRLi overlaps the internal clock signal CKIi+1 supplied to the latch circuit group Si+1adjacent to the latch circuit group Si for at least one clock as explained above, both the rising and falling of the pulse signal can be transmitted throughout the shift register circuit 1.

Accordingly, it has become possible to prevent an unwanted event that only one of the rising and falling of the signal is transmitted because the internal clock signals CKI do not overlap at all.

In the above-arranged data signal line driving circuit, the latch circuit group Si in the shift register circuit 1 is selected by the external block selection signal BLKi. In the following, another type of shift register circuit which selects the latch circuit group Si without using the external block selection signal BLK will be explained with reference to FIGS. 6 through 9.

Figure 6:
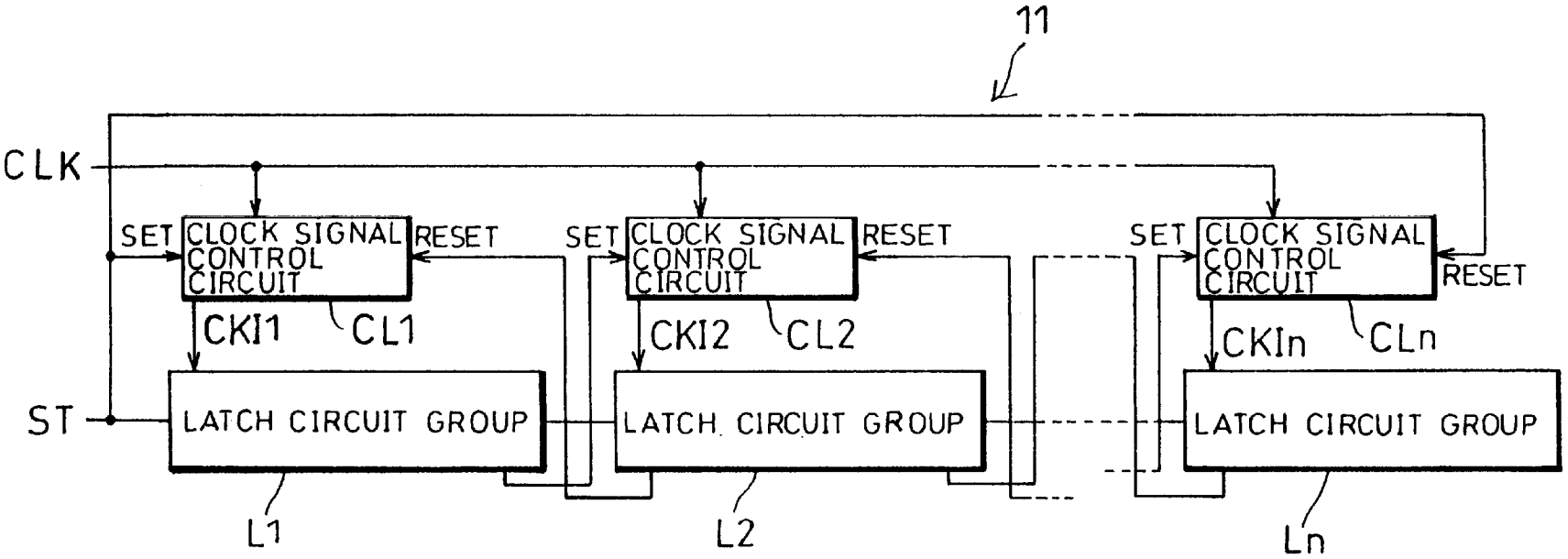
FIG. 6 is a block diagram schematically showing a shift register circuit in a data signal line driving circuit in accordance with another example embodiment of the present invention.

As shown in FIG. 6, a shift register circuit 11 includes a plurality of latch circuit groups Li (i=1, 2, . . . , n), and clock signal control circuits CLi (i=1, 2, . . . , n) for supplying the internal clock signals CKIi (i=1, 2, . . . , n) to the individual latch circuit groups Li.

Each clock signal control circuit CL receives the external clock signal CLK, a set signal SET and a rest signal RESET for selecting a particular latch circuit group L from which the external clock signal CLK is supplied under control. Also, each clock signal control circuit CL selectively outputs the external clock signal CLK as an internal clock signal CKI to the corresponding latch circuit group L. Although it is not illustrated in the drawing, an internal clock signal $\overline{CKI}$, which is an inverted signal of the internal clock signal CKI, is outputted simultaneously with the internal clock signal CKI.

Thus, the clock signal control circuits CL are provided in the matching numbers with the latch circuit groups L, that is, n clock signal control circuits CL are provided. As shown in FIG. 2, each latch circuit group L includes a plurality of serially connected latch circuits LAT. The numbers of the latch circuits LAT included in the latch circuit groups L are set so as to increase monotonously with a distance from the input side.

Here, an output signal from any of the latch circuit LAT in the latch circuit group Li−1 preceding the latch circuit group Li is used as the set signal SET. A start signal ST is inputted into the first latch circuit group L1 as the set signal SET.

Also, an output signal from any of the latch circuit LAT in the latch circuit group Li+1 following the latch circuit group Li is used as the reset signal RESET. The start signal ST is inputted into the last latch circuit group Ln as the reset signal RESET.

On the other hand, each latch circuit group L receives the corresponding internal clock signal CKI, and the start signal ST, which is in effect a pulse signal, is inputted into the first latch circuit group L1.

Figure 7:
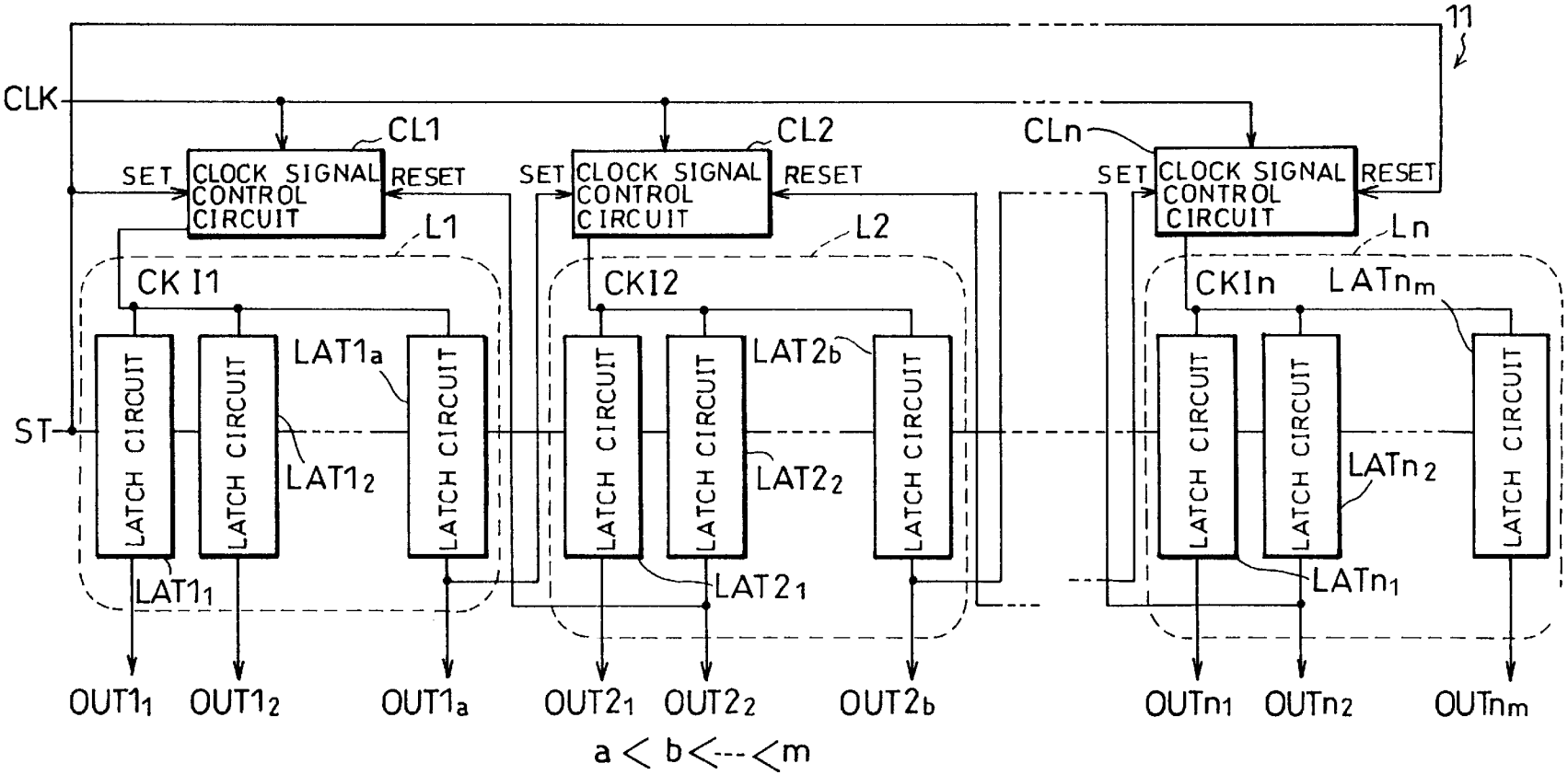
FIG. 7 is a block diagram depicting an arrangement of the shift register circuit of FIG. 6.

The above-arranged shift register circuit 11 will be explained more in detail with reference to FIG. 7.

The set signal SET and reset signal RESET inputted into the clock signal control circuit CL are generated in the following manner.

That is, as previously mentioned, an output signal from the latch circuit $LAT(i-1)_z$ (z=a, b, . . . , m, where a<b< . . . <m) in the last stage of the latch circuit group Li−1 preceding to the latch circuit group Li is used as the set signal SET. Since the first latch circuit group L1 has no preceding latch circuit group, the start signal ST is used as the set signal SET.

On the other hand, as previously mentioned, an output signal from the second latch circuit $LATi+1_2$ in the latch circuit group Li+1 following the latch circuit group Li is used as the reset signal RESET. Since the last latch circuit group Ln has no following latch circuit group, the start signal ST is used as the reset signal RESET.

A circuit arrangement of the clock signal control circuit CL will be explained in detail with reference to FIG. 8.

Figure 8:
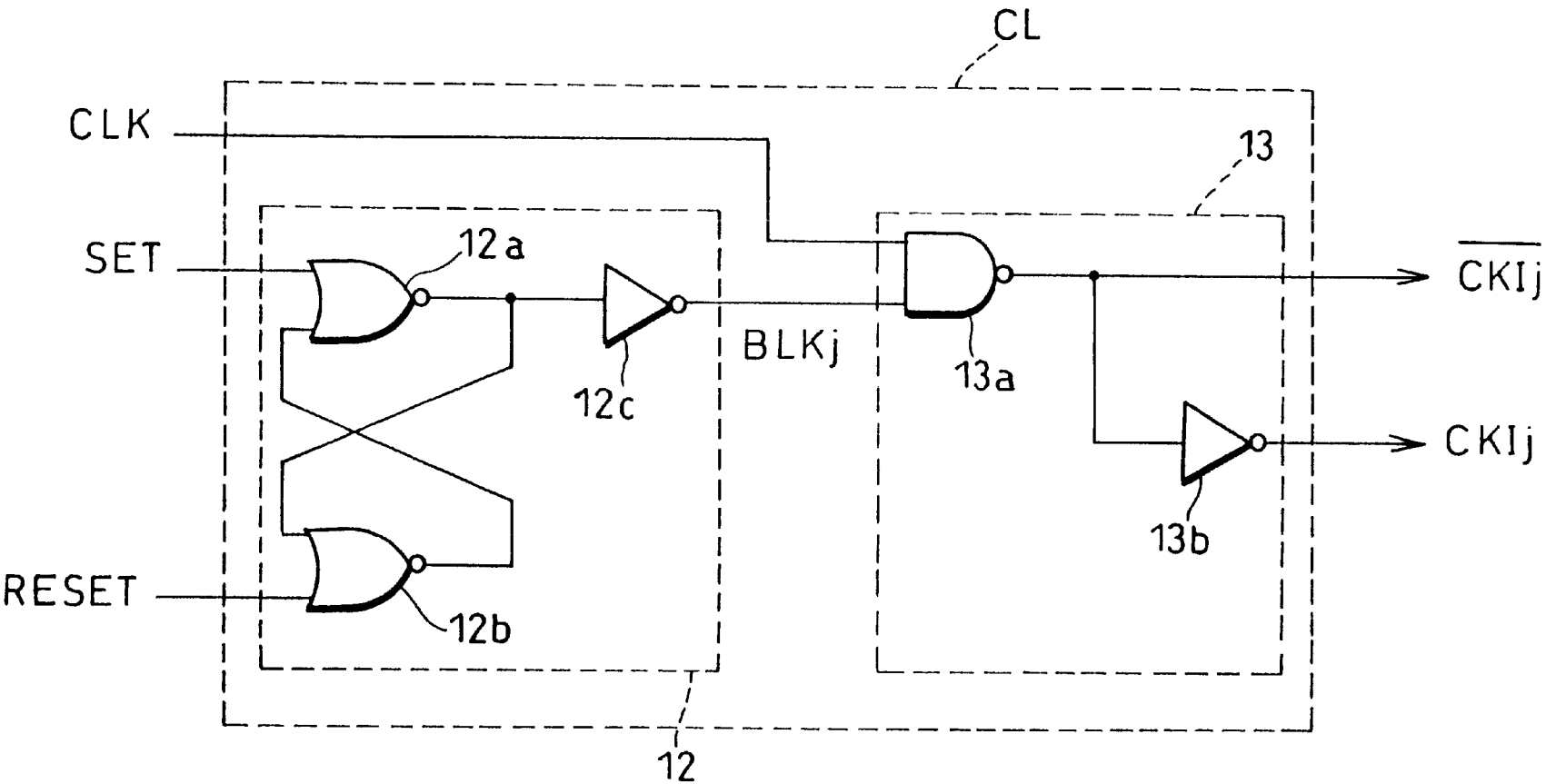
FIG. 8 is a block diagram schematically showing a clock signal control circuit in the data signal line driving circuit of FIG. 6.

As shown in FIG. 8, the clock signal control circuit CL comprises a block selection signal generating section 12 composed of two NOR (negative OR) circuits 12*a* and 12*b* and one inverter 12*c*, and an internal clock signal generating section 13 composed of one NAND (Negative AND) circuit 13*a* and one inverter 13*b*.

The NOR circuit 12*a* in the block selection signal generating section 12 receives the set signal SET, while the other NOR circuit 12*b* receives the reset signal RESET. The NOR circuit 12*a* uses an output signal from the NOR circuit 12*b* as the reset signal, and the NOR circuit 12*b* uses an output signal from the NOR circuit 12*a* as the set signal.

The inverter 12*c* in the block selection signal generating section 12 receives an output signal from the NOR circuit 12*a*. Also, the inverter 12*c* outputs the block selection signal BLKj to the internal clock signal generating section 13.

The NAND circuit 13*a* in the internal clock signal generating section 13 receives the external clock signal CLK and the block selection signal BLKj from the block selection signal generating section 12. Also, the NAND circuit 13*a* outputs the external clock signal CLK as the internal clock signal $\overline{CKIj}$ when the block selection signal BLKj is in the active state.

Further, the internal clock signal generating section 13 inverses the internal clock signal $\overline{CKIj}$ outputted from the NAND circuit 13*a* by means of the inverter 13*b* and outputs the same as the internal clock signal CKIj.

In other words, in the block selection signal generating section 12 of the above-arranged clock signal control circuit CL, the block selection signal BLKj shifts to the high level (active state) when the NOR circuit 12*a* receives the set signal SET and remains at the high level until the NOR circuit 12*b* receives the reset signal RESET. Whereas in the internal clock signal generating section 13 of the above-arranged clock signal control circuit CL, the internal clock signals CKIj and $\overline{CKIj}$ are generated by capturing the external clock signal CLK.

On the other hand, when the reset signal RESET is inputted into the NOR circuit 12*b*, the block selection signal BLKj shifts to the low level and remains at the low level until the NOR circuit 12*a* receives the set signal SET. Thus, the internal clock signals CKIj and $\overline{CKIj}$ are not generated and the output from the internal clock signal generating section 13 is fixed to a constant bias.

In this manner, unlike the clock signal control circuit CRL of FIG. 2 that uses the external block selection signal BLK, the above-arranged clock signal control circuit CL selectively supplies the internal clock signal CKI to the corresponding latch circuit group L based on the output signal from the other latch circuit groups L without using the external block selection signal BLK.

Thus, since each latch circuit LATj in the latch circuit group Lj receives the internal clock signals CKIj and $\overline{CKIj}$ while the latch circuit group Lj is selected, that is, while it is in the selection state, the pulse signal can shift normally.

While the latch circuit group Lj is not selected, that is, while it is in the non-selection state, a constant bias is supplied to the internal clock signal line. Consequently, the latch circuit LAT can also remain in a stable state during the non-selection state, thereby making it possible to prevent a malfunction, for example, an event where a pulse is outputted in response to a change in the potential level of the internal node caused by noise or the like.

Figure 9:
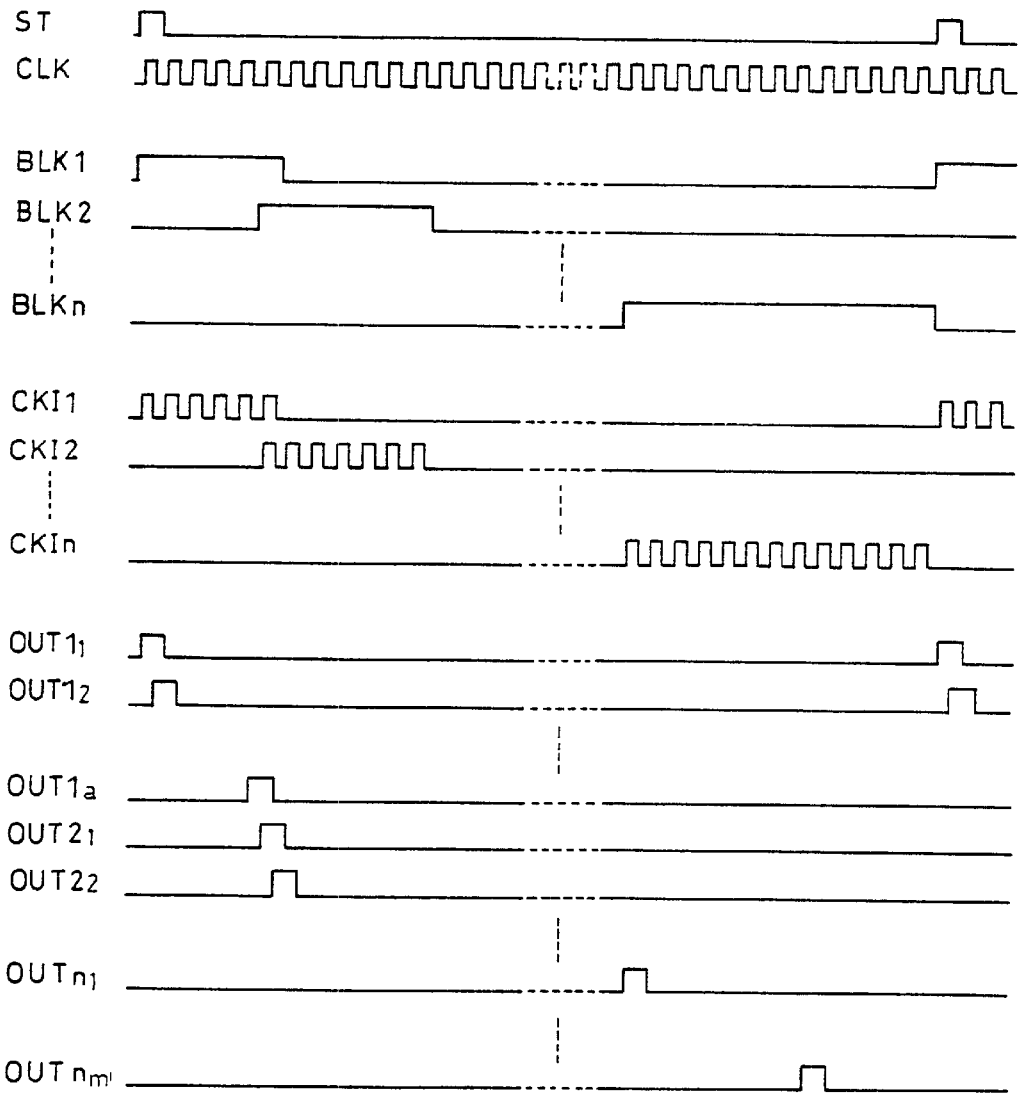
FIG. 9 is a view showing the waveform of each signal in the data signal line driving circuit of FIG. 6.

Here, the operation of the shift register circuit 11 of FIG. 7 will be explained with reference to FIGS. 8 and 9. FIG. 9 is an illustration of the waveform of each signal in the shift register circuit 11. In the following example, assume that the latch circuit groups L are composed of the latch circuits LAT of 10, 12, . . . , 16 stages, respectively.

In the shift register circuit 11, the block selection signal BLK1 generated by the block selection signal generating section 12 in the clock signal control circuit CL1 is activated by the start signal ST, whereby the internal clock signal CKI1 is outputted.

The pulse signal is sequentially transmitted throughout the latch circuit group L1 in sync with the internal clock signal CKI1. When an output signal $OUT1_a$ is outputted from the latch circuit $LAT1_a$ in the last stage of the latch circuit group L1, the block selection signal BLK2 in the following clock signal control circuit CL2 is activated, whereby the internal clock signal CK12 is outputted.

The pulse signal is sequentially transmitted throughout the latch circuit group L2 in sync with the internal clock signal CKI2. Then, the latch circuit $LAT2_2$ at the second stage in the latch circuit group L2 outputs an output signal $OUT2_2$, which is inputted into the block selection signal generating section 12 in the preceding clock signal control circuit CL1 as the reset signal RESET. Consequently, the block selection signal BLK1 in the clock signal control circuit CL1 is deactivated, whereby the output of the internal clock signal CKI1 is inhibited.

In other words, the clock signal control circuit CL1 keeps outputting the internal clock signal CKI1 until the pulse signal is transmitted to the latch circuit $LAT2_2$ at the second stage in the following latch circuit group L2. Thus, the pulse signal up to the falling can be transmitted in an accurate manner.

After the pulse signal $OUTn_m$ is transmitted from the latch circuit $LATn_m$ at the last stage in the last latch circuit group Ln, the start signal ST of the following sequence is inputted as the reset signal RESET for the last latch circuit group, and the block selection signal BLKn in the clock signal control circuit CLn is deactivated.

Instead of using the start signal ST as the reset signal RESET for the last latch circuit group Ln, an additional block composed of the latch circuits for two stages may be provided to the shift register circuit 11, so that the additional block. generates the reset signal RESET. According to this arrangement, the pulse signal is transmitted to the additional block after it is transmitted to the latch circuit $LATn_m$ at the last stage in the last latch circuit group Ln. Further, the pulse signal having passed through the additional block is given to the last latch circuit group Ln as the reset signal RESET. In this case, the supply of the clock signal to the last latch circuit group Ln can be stopped before the input of the signal ST. Thus, the power consumption can be reduced more efficiently.

According to the above-arranged shift register circuit 11 regardless of the generating method of the reset signal RESET, the clock signal can be inputted only to the latch circuits near the node to which the pulse signal is transmitted. Thus, a less power consuming shift register circuit 11 can be realized only by adding a circuit of a relatively small size.

Since the block selection signal is generated inside the shift register circuit 11, the terminal for receiving the block selection signal from the external can be omitted unlike the case where the block selection signal is inputted from the external. Thus, the input terminals around the shift register circuit 11 can be simplified, thereby making it easier to package the peripheral circuits, such as a controller, to the panel in a more reliable manner.

Further, since the shift register circuit 11 uses a part of its own output signals as the set signal SET and reset signal RESET for the clock signal control circuit CL which controls the corresponding latch circuit group L. Thus, even when the clock signal control circuits CL are of the same arrangement, the stage numbers of the latch circuits in each latch circuit group can be set arbitrary. However, in case that a counter circuit is used as the clock signal control circuit CL, the arrangement of the counter circuit needs to be modified depending on the stage numbers in the latch circuit group Ls or the stage numbers of the latch circuits in the latch circuit groups L.

In the above-arranged shift register circuit 11, the block selection signal BLKi of the latch circuit group Li is set by the output from the latch circuit LAT at the last stage in the preceding latch circuit group Li−1. However, the arrangement is not limited to this, and an output from any latch circuit LAT provided before the latch circuit LAT at the last stage of the preceding latch circuit group Li−1 can be used as well. In addition, when a delay of a signal in the clock signal control circuit CL is not sufficiently small compared with a clock cycle of the external clock signal CLK, an output from the latch circuit provided well before the latch circuit group Li can be used as the set signal SET.

Likewise, in the above-arranged shift register circuit 11, the block selection signal BLK of the latch circuit group Li is reset by the output from the latch circuit LAT at the second stage in the following latch circuit group Li+1. However, the arrangement is not limited to this, and an output from any latch circuit LAT provided after the latch circuit LAT at the last stage of the latch circuit group Li can be used as well.

Figure 10:
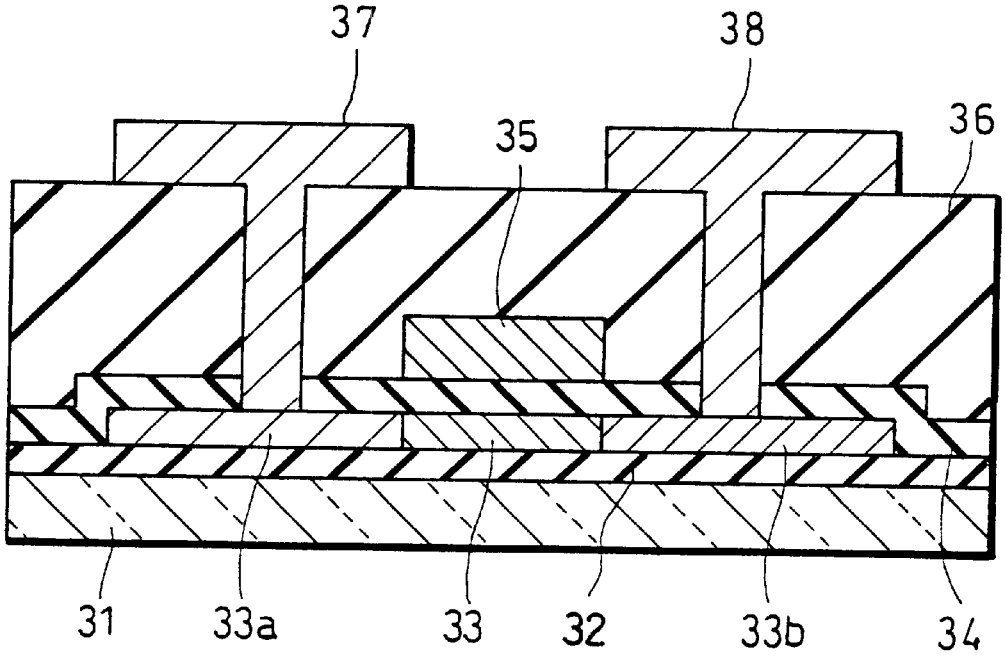
FIG. 10 is a cross section schematically showing a thin film transistor forming the data signal line driving circuit of the present invention.

The data signal line driving circuit of the present invention is composed of a polycrystalline silicon thin film transistor, which will be explained in the following with reference to FIG. 10.

As shown in the drawing, the polycrystalline silicon thin film transistor is made out of a polycrystalline silicon thin film 33 formed over a dielectric transparent substrate 31 through a silicon oxide film 32. A gate electrode 35 is formed above the polycrystalline silicon thin film 33 through a silicon oxide film 34 which will be made into a gate oxide film. The entire surface of these elements are covered with a silicon oxide film 36 serving as a protection film. A source electrode 37 and a drain electrode 38 are respectively connected to a source area 33*a* and a drain area 33*b* made out of the polycrystalline silicon thin film by penetrating through the silicon oxide films 36 and 34.

The above-arranged polycrystalline silicon thin film transistor is a transistor that uses the polycrystalline silicon thin film formed over the dielectric substrate as an active layer, and its cross section structure is similar to the structure of a monocrystal silicon MOS type electrical field effect transistor used in LSIs.

Thus, when the data signal line driving circuit is composed of the above silicon thin film transistor, the element is upsized and a higher driving voltage is demanded, thereby increasing the power consumption. Hence, if the data signal line driving circuit can operate partially like in the above-arranged data signal line driving circuit, a better power consumption reducing effect can be offered.

Also, when the data signal line driving circuit is composed of the above silicon thin film transistor, the drivability of the element is reduced, but in turn, the element size is upsized. Thus, a delay in each signal line becomes larger, and the time difference between the clock signal line and video signal line may increase considerably (the timing may shift considerably).

However, when the stage numbers of the latch circuits LAT in each latch circuit group S is changed like in the data signal line driving circuit of the present embodiment, a delay difference between the clock signal line and video signal line can be minimized. Consequently, a satisfactory video can be displayed without unwanted blur or ghost caused by the time difference between the clock signal and the video signal outputted in sync with the clock signal.

An image display apparatus employing the data signal line driving circuit of Embodiment 1 will be explained in Embodiment 2 below.

Embodiment 2

Referring to FIGS. 11 through 14(*k*), the following description will describe another example embodiment of the present invention. Hereinafter, like components are labeled with like reference numerals with respect to Embodiment 1, and the description of these components is not repeated for the explanation's convenience. In the present invention, the explanation will be given using a liquid crystal display device adopting an active matrix driving method as an example image forming apparatus.

Figure 11:
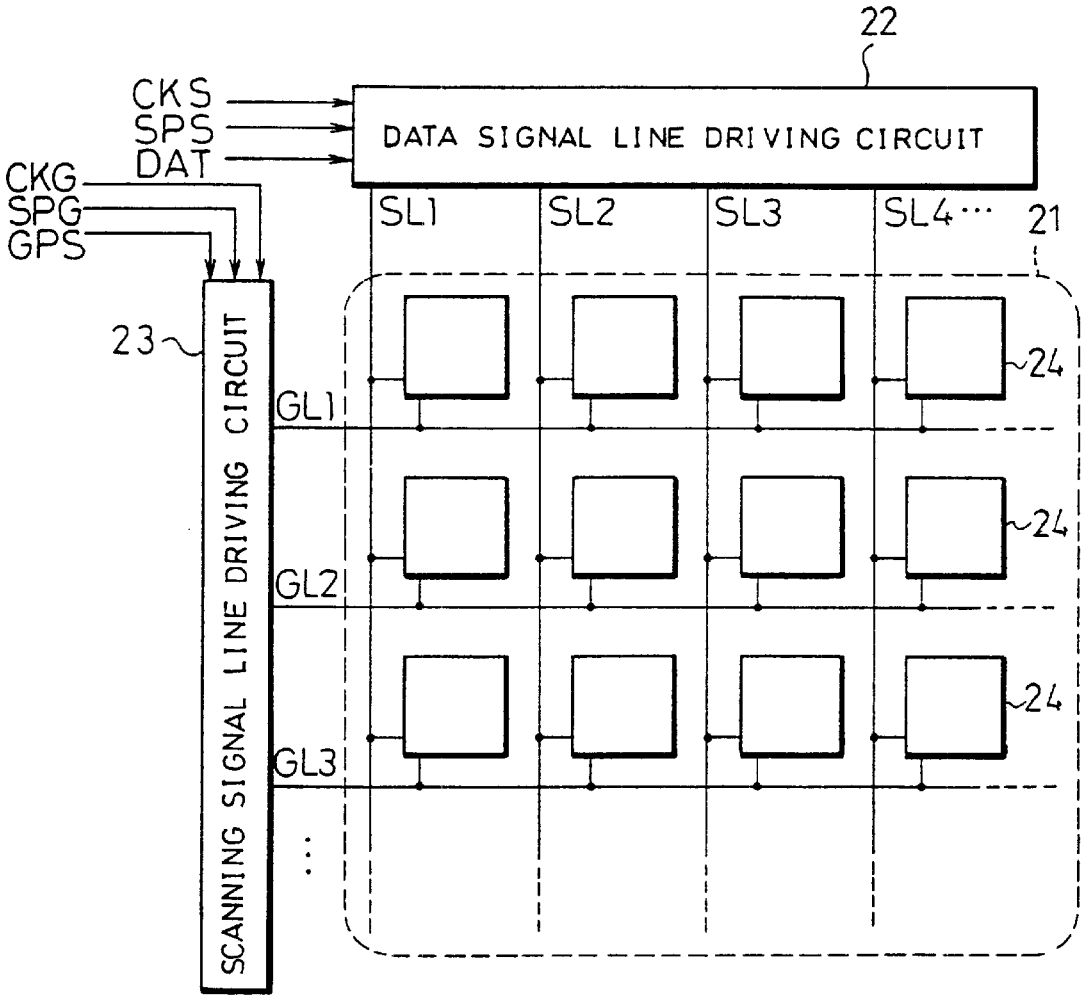
FIG. 11 is a view schematically showing an arrangement of an example image display apparatus of the present invention.

As shown in FIG. 11, a liquid crystal display device of the present embodiment is composed of a pixel array 21, a data signal line driving circuit 22, and a scanning signal line driving circuit 23.

The pixel array 21 is furnished with a plurality of scanning signal lines GLi (i=1, 2, . . . , x) and a plurality of data signal lines SLi (i=1, 2, . . . , y) which intersect with each other. A pixel 24 is provided in each portion enclosed by two adjacent scanning signals GL and two adjacent data signal lines SL. In other words, a matrix of a plurality of pixels 24 is provided on the pixel array 21. Here, (x)×(y) pixels 24 are provided: in case of the VGA panel, 640×480 pixels 24 are provided and 1024×768 pixels 24 are provided in case of the XGA panel.

Figure 12:
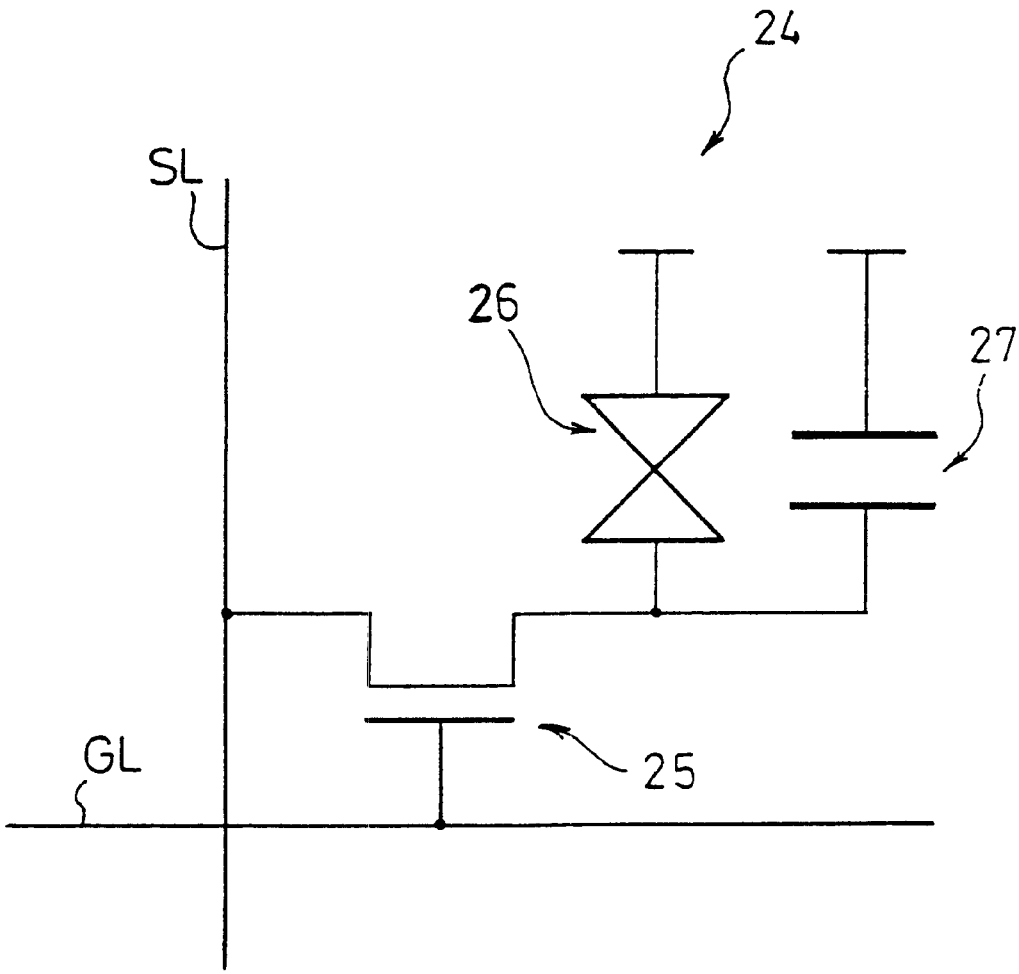
FIG. 12 is a view schematically showing an internal arrangement of each pixel provided to the image display apparatus of FIG. 11.

As shown in FIG. 12, each pixel 24 is composed of an electrical field transistor 25 serving as a switching element, a liquid crystal capacitance 26, and an auxiliary capacitance 27. The liquid crystal capacitance 26 and auxiliary capacitance 27 form a pixel capacitance. However, the auxiliary capacitance 27 is not essential and can be added only when necessary.

The source electrode of the electrical field effect transistor 25 is connected to the data signal line SL, and the gate electrode of the same is connected to the scanning signal line GL. Also, the drain electrode of the electrical field effect transistor 25 is connected to either electrode of the liquid crystal capacitance 26 and either electrode of the auxiliary capacitance 27 in parallel.

The other electrodes of the liquid crystal capacitance 26 and auxiliary capacitance 27, that is, the electrodes of these capacitances which are not connected to the drain electrode of the electrical field effect transistor 25, are connected to a common electrode line (not shown) for all the pixels 24. The liquid crystal capacitance 26 displays an image by changing the transmittance or reflectance of the liquid crystal with an applied voltage.

As has been explained, in each pixel 24, the signal supplied to the data signal lines SL is switched ON/OFF at the timing of the signal supplied to the scanning signal lines GL, so that it is applied to the liquid crystal capacitance 26 and auxiliary capacitance 27 in the form of a voltage.

As shown in FIG. 11, the data signal line driving circuit 22 is connected to a plurality of the data signal lines SL, and receives a clock signal CKS, a start signal SPS, and a data signal DAT transmitted as a video signal. Thus, the data signal DAT is sampled in sync with the input clock signal CKS and start signal SPS and amplified if necessary, after which the data signal DAT is written into the data signal lines SL.

On the other hand, the scanning signal line driving circuit 23 is connected to a plurality of the scanning signal liens GL, and receives a clock signal CKG, a start signal SPG, and a pulse signal GPS. Thus, the video signal (data signal DAT) written into the data signal lines SL is written into the pixels 24 as the opening/closing of the switching element in each pixel 24 is controlled by sequentially selecting the scanning signals GL in sync with the input clock signal CKG and start signal SPG. The written data signal DAT is withheld in the pixels 24.

Here, the data signal driving circuit of Embodiment 1 is used as the data signal line driving circuit 22, and a conventional scanning signal driving circuit is used as the scanning signal line driving circuit 23.

As has been explained in Embodiment 1, the data signal line driving circuit 22 can save the power consumed by the clock signal which drives the shift register circuit included therein. In addition, the time difference between the clock signal and the video signal can be minimized. Consequently, it has become possible to provide a liquid crystal display device which can produce an image with a satisfactory image quality while consuming less power.

The pixel array 21 and both the data signal line driving circuit 22 and scanning signal line driving circuit 23 may be provided on the same substrate. In this case, the data signal line driving circuit 22 and scanning signal line driving circuit 23 can be assembled in the same step. Moreover, the connecting process (packaging step) of connecting each driving circuit to the pixel array 21 can be omitted. Thus, it has become possible to reduce the cost of the image forming apparatus while improving the reliability thereof.

In other words, when the data signal line driving circuit 22 and/or scanning signal line driving circuit 23 and the pixel array 21 are formed separately, a process of connecting the driving circuits to the pixels is indispensable, and the connection deficiency occurs during this connecting process, thereby reducing the reliability of the circuit. However, if the driving circuit(s) and pixels are formed in the same process like in the present embodiment, this process can be omitted. Thus, since deficiency caused during the process of connecting the driving circuits to the pixels can be eliminated, the reliability of an image forming apparatus having the driving circuits furnished with the scanning circuits can be improved.

A liquid crystal display device, in which the pixel array 21, data signal line: driving circuit 22 and scanning signal line driving circuit 23 are formed on the same substrate, will be explained in the following.

Figure 13:
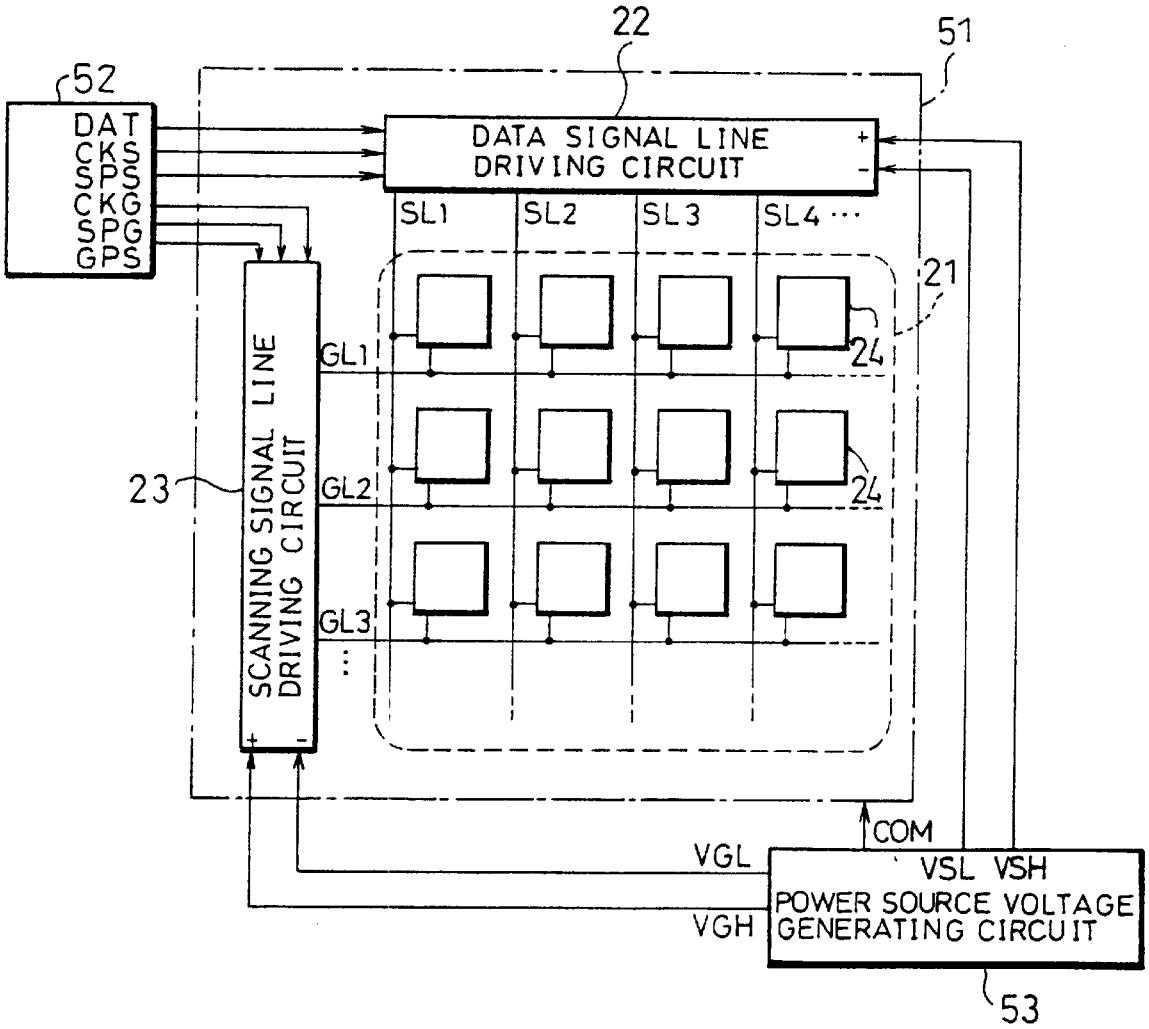
FIG. 13 is a view schematically showing an arrangement of another example image display apparatus of the present invention.
Figure 14A:
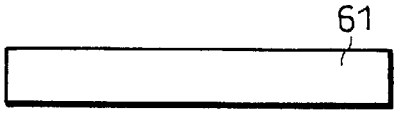
FIGS. 14(*a*) through 14(*k*) are views explaining a producing process of a thin film transistor forming the image display apparatus of FIG. 13.
Figure 14B:
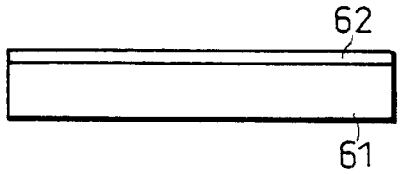
Figure 14C:
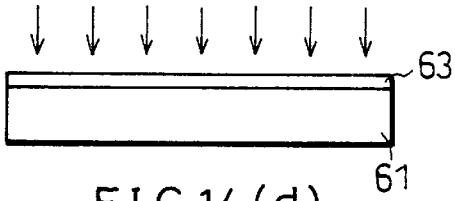
Figure 14D:
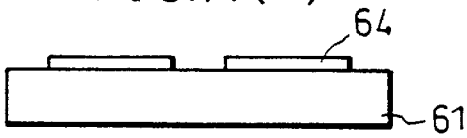
Figure 14E:
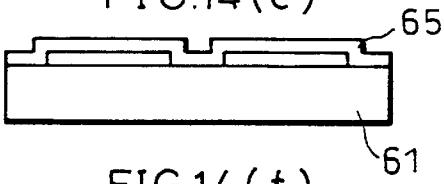
Figure 14F:
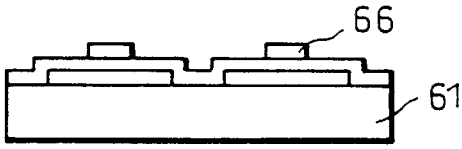
Figure 14G:
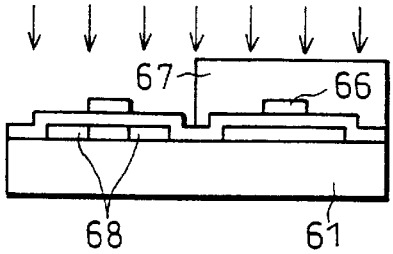
Figure 14H:
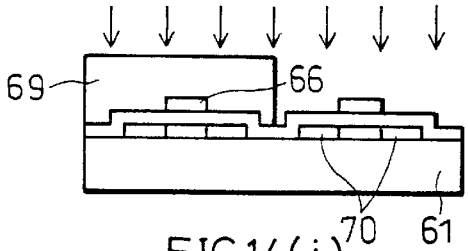
Figure 14I:
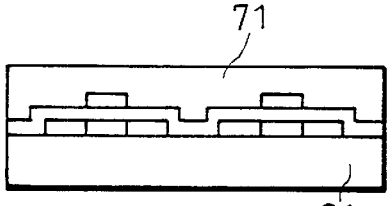
Figure 14J:
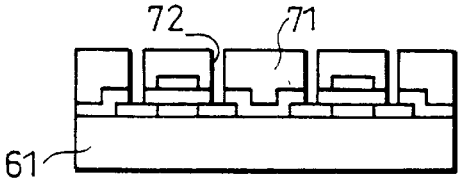
Figure 14K:
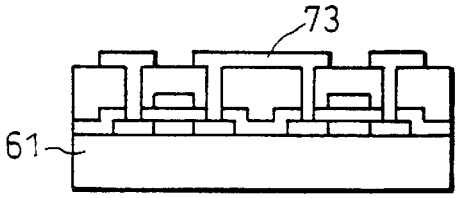
Figure 15:
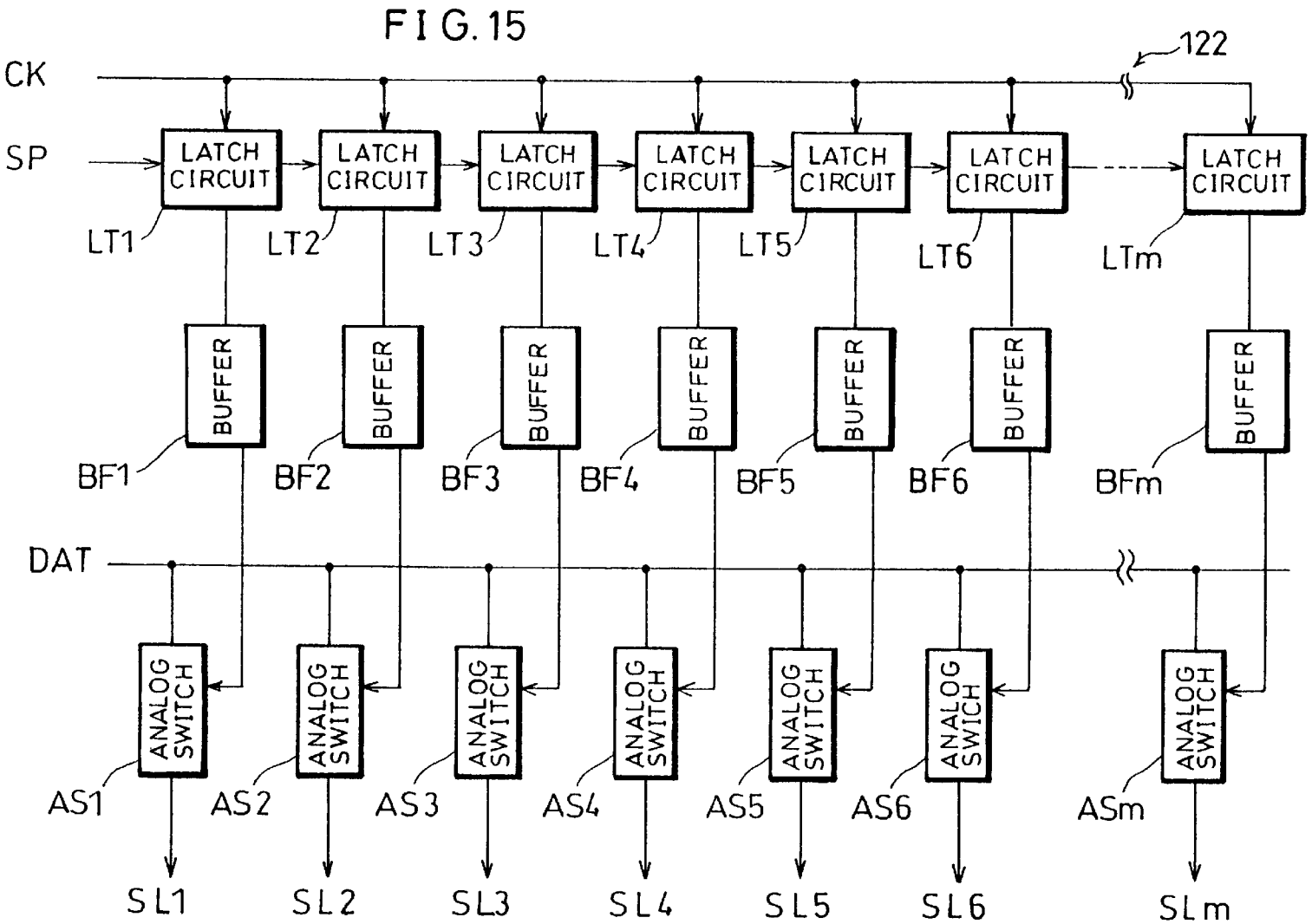
FIG. 15 is a block diagram schematically showing an arrangement of a conventional data signal line driving circuit.
Figure 16:
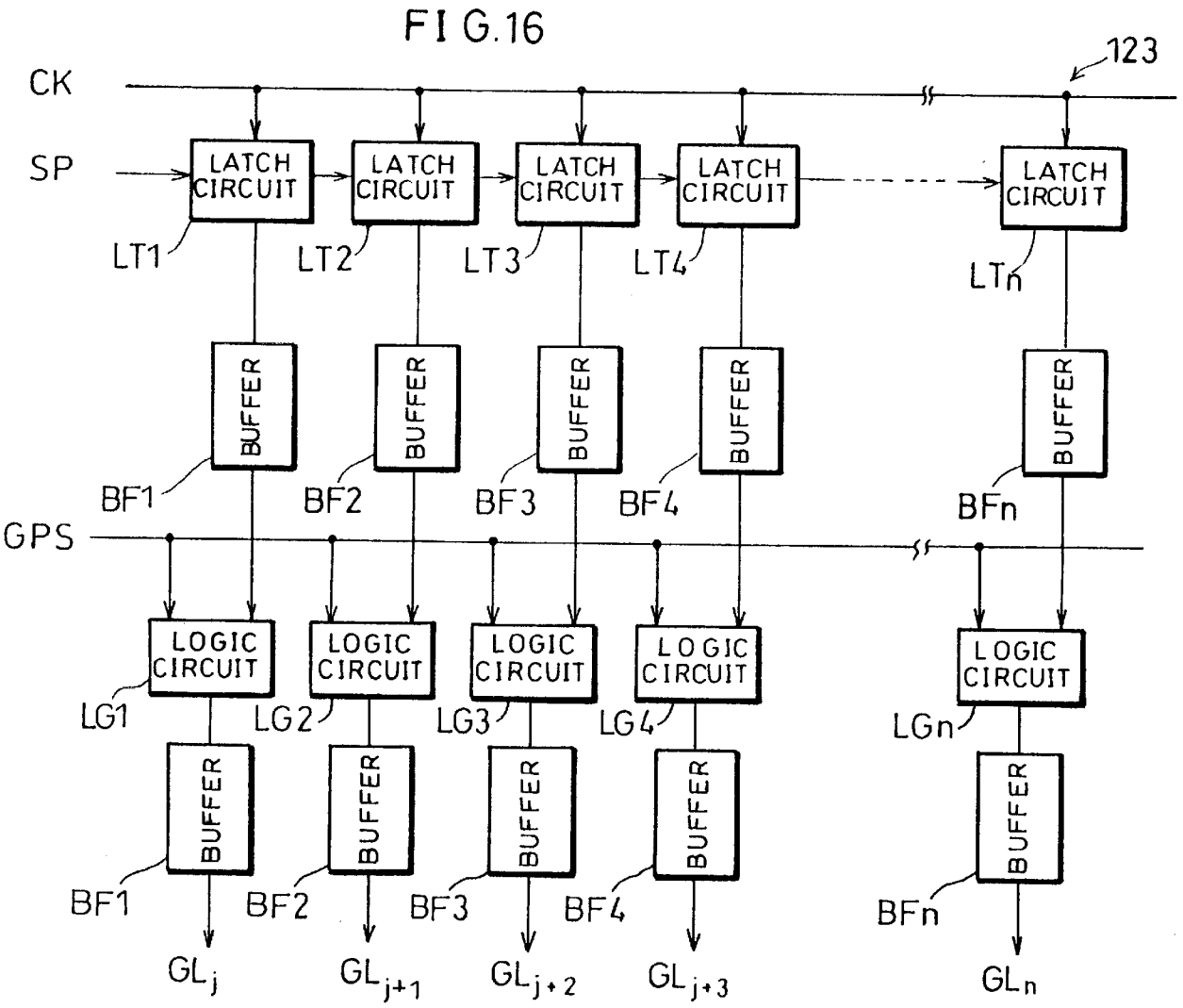
FIG. 16 is a block diagram schematically showing an arrangement of a conventional scanning signal line driving circuit.
Figure 17:
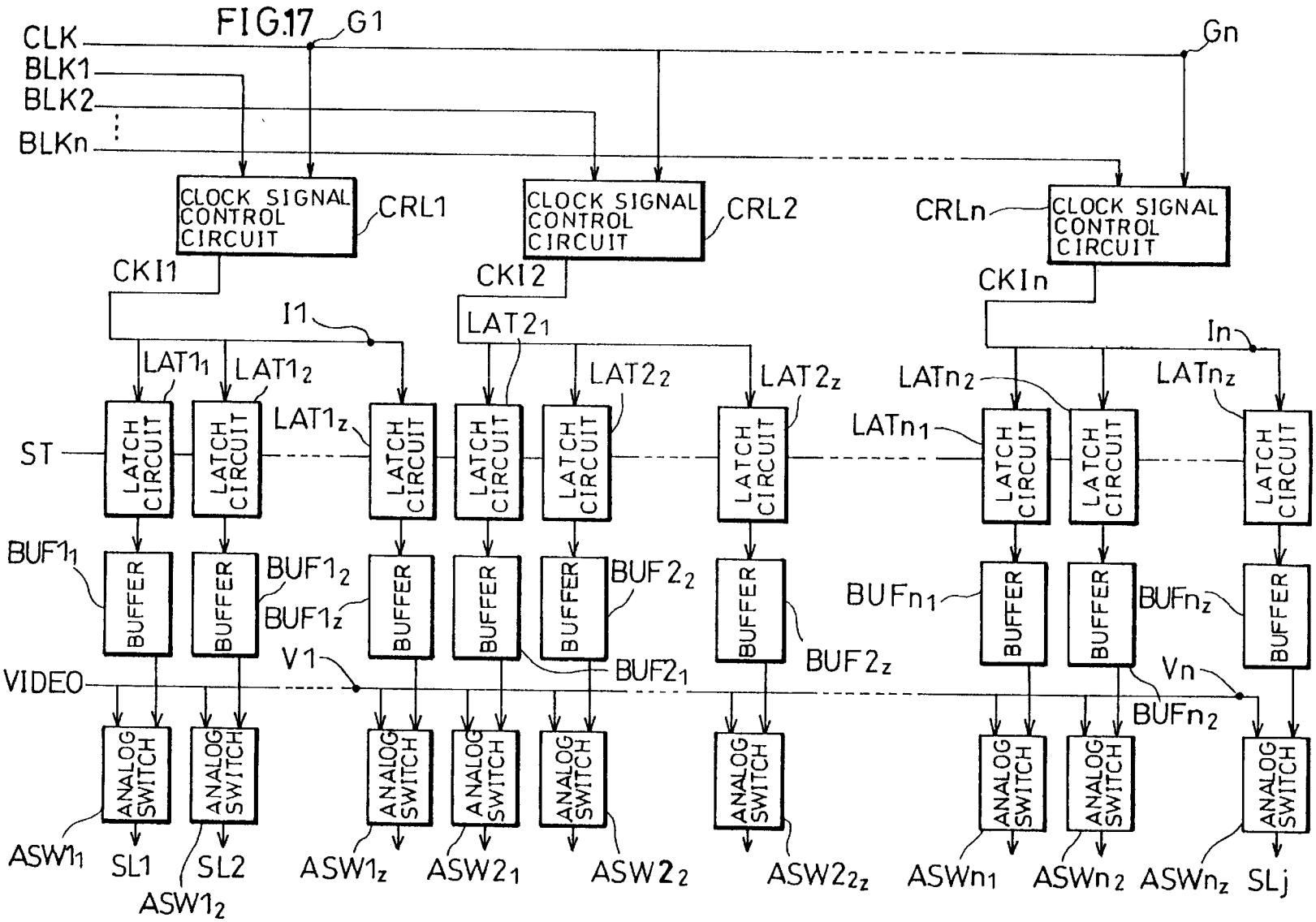
FIG. 17 is a block diagram schematically showing an arrangement of another conventional data signal line driving circuit.
Figure 18:
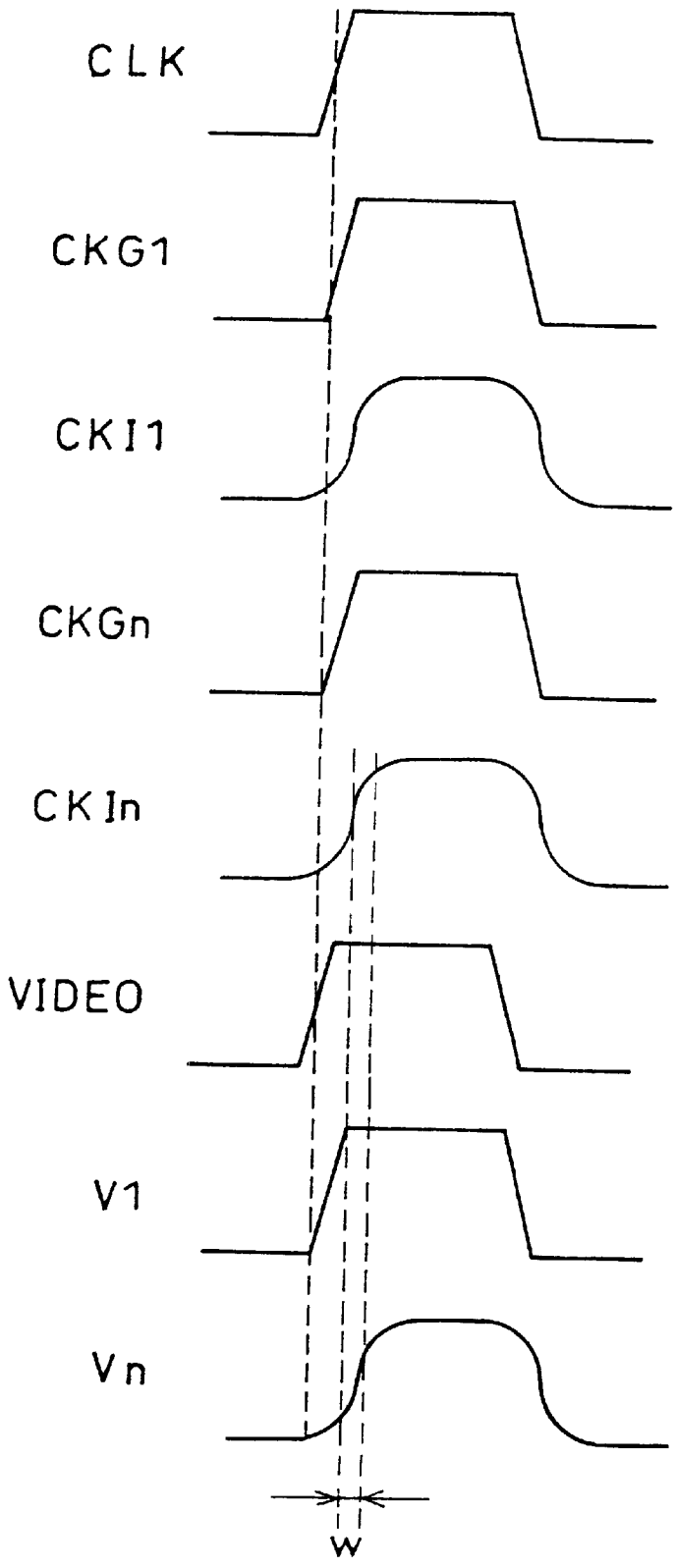
FIG. 18 is a view showing the waveform of each signal at arbitrary points. in the data signal line driving circuit of FIG. 17.

As shown in FIG. 13, the above liquid crystal display device is arranged in such a manner that the data signal line driving circuit 22 and scanning signal line driving circuit 23, both composed of polycrystalline silicone thin film transistor, on a dielectric substrate 51 on which the pixel array 21 is also formed.

Both the data signal line driving circuit 22 and scanning signal line driving circuit 23 are connected to a timing signal generating circuit 52. The timing signal generating circuit 52 generates timing signals: signals which are outputted to the data signal line driving circuit 22, namely, the data signal DAT, clock signal CKS, and start signal SPS; and signals which are outputted to the scanning signal line driving circuit 23, namely, the clock signal CKG, start signal SPG, and pulse signal GPS.

Thus, when the data signal line driving circuit 22 and scanning signal line driving circuit 23 are composed of the polycrystalline silicon thin film transistor formed over the dielectric substrate 51 on which the pixel array 21 is also formed in the above manner, the data signal line driving circuit 22 and scanning signal line driving circuit 23 can be assembled in the same step. Moreover, the connecting process (packaging process) of connecting each driving circuit to the pixel array 21 can be omitted. Thus, the manufacturing costs of the image forming apparatus can be saved. Also, since the deficiency caused during the connecting process can be eliminated, the reliability of the image forming apparatus can be improved.

Further, both the data signal line driving circuit 22 and scanning sinal line driving circuit 23 are connected to a power source voltage generating circuit 53. The power source voltage generating circuit 53 generates low power source voltages VSL·VGL and high power source voltages VSH·VGH, both of which are supplied to the data signal line driving circuit 22 and scanning signal line driving circuit 23, respectively. The power source voltage generating circuit 53 also generates a COM voltage supplied to the common electrode connected to all the pixels 24 in the pixel array 21.

In other words, the liquid crystal display device of FIG. 13 is arranged in such a manner that the power source voltage generating circuit 53 applies the low power source voltage VSL-VGL or high power source voltage VSH-VGH to the data signal line driving circuit 22 and scanning signal driving circuit 23, respectively. Thus, it is preferable to use the scanning circuit of FIG. 6 in Embodiment 1, which is arranged to apply a constant bias to non-selected blocks, for the data signal line driving circuit 22 and scanning signal line driving circuit 23.

In each of Embodiments 1 and 2, only one of the clock signal lines and block selection signal lines are described in some cases. However, assume that inverting signal lines which receive inverting signals of the clock signal and block selection signal are arranged and provided in the same manner as the aforementioned clock signal lines and block signal lines.

When polycrystalline silicon thin film transistor is produced at 600° C. or below, a large inexpensive glass substrate can be used. In other words, if the polycrystalline silicon thin film transistor shown in FIG. 10 of Embodiment 1 is used for the present liquid crystal display device, an inexpensive image forming apparatus with a large-scale screen can be realized.

If the active elements are formed at such a low temperature, the elements are driven with a lower drivability but they are further upsized. Thus, the delay in each kind of the signal lines may be increased, and so is the time difference between the clock signal lines and the video signal lines.

However, a delay difference between the clock signal lines and video signal lines can be minimized by changing the stage numbers of the latch circuits LAT in each latch circuit group S like in the data signal line driving circuit of the present embodiment. Consequently, a satisfactory video can be displayed without unwanted blur or ghost caused by the time difference between the clock signal and the video signal outputted in sync with the clock signal.

Here, a process of producing the polycrystalline silicon thin film transistor at 600° C. or below will be explained with reference to FIGS. 14(*a*) through 14(*k*).

To begin with, as shown in FIGS. 14(*a*) through 14(*c*), an amorphous silicon thin film 62 is layered over a glass substrate 61, and a laser beam is irradiated to the amorphous silicon thin film 62 from an excimer laser, whereupon a polycrystalline silicon thin film 63 is formed.

Then, as shown in FIGS. 14(*d*) and 14(*e*), the polycrystalline silicon thin film 63 is patterned into a desired shape to form active areas 64, on which a gate insulation film 65 is formed.

Then, as shown in FIG. 14(*f*), gate electrodes 66 of the thin film transistor are made of aluminium or the like.

Subsequently, as shown in FIG. 14(*g*), one of the gate electrodes 66 of the thin film transistor is covered with a resist material 67, after which $P^+$ ion doping is carried out. Consequently, on the active area 64 of the other gate electrode 66 which is not covered with the resist material 67, an area which is not covered with the gate electrode 66 is secured as an $n^+$ area 68.

Further, as shown in FIG. 14(*h*), after the resist material 67 formed in the step of FIG. 14(*g*) is removed and the other gate electrode 66 of the thin film transistor is covered with a resist material 69, after which $B^+$ ion doping is carried out. Consequently, on the active area 64 of the other gate electrode 66 which is not covered with the resist material 69, an area which is not covered with the gate electrode 66 is secured as a $p^+$ area 70.

In other words, in the steps of FIGS. 14(*g*) and 14(*h*), impurities (phosphorous for the n-type area and boron for the p-type area) are doped into the source and drain areas of the thin film transistor.

Subsequently, as shown in FIG. 14(*i*), an interlayer insulation film 71 made of silicon dioxide or silicon nitride is layered on the thin film transistor having thereon formed the $n^+$ area 68 and $p^+$ area 70.

Then, as shown in FIGS. 14(*j*) and 14(*k*), after contact holes 72 are made through the interlayer insulation film 71, a metal wire 73 made of aluminium or the like is formed.

In the above procedure, the maximum process temperature is 600° C. when the gate insulation film is formed. Thus, high-heat-resistant glass, such as 1737 glass of Corning Inc. can be used.

In the above liquid crystal display device, after the polycrystalline silicon thin film transistor is formed, a transparent electrode (in case of a transmission liquid crystal display device) or a reflective electrode (in case of a reflective liquid crystal display device) is formed through another interlayer insulation film.

As has been explained, a data signal line driving circuit of the present invention comprises:

a shift register circuit, composed of a plurality of serially connected latch circuits, for sequentially transmitting a pulse signal in sync with a rising and a falling of a clock signal; and an output circuit for sequentially outputting data signals to data signal lines in sync with the pulse signals outputted from the shift register circuit, and the above data signal line driving circuit is characterized in that:

the shift register circuit is divided into a plurality of blocks, stage numbers of the latch circuits in each block is set in such a manner to minimize time difference between the pulse signal outputted from each block and the data signal outputted in sync with the pulse signal.

Incidentally, when the shift register circuit is divided into a plurality of blocks each including -the same stage numbers, the load of the clock signal line which receive an external input is small, while a delay in the clock signal in each block is substantially the same. Thus, a delay in the clock signal between the first and last blocks becomes small. In contrast, since the output circuit is not divided into blocks, the load of the signal line which supplies the data signal is large. Thus, the data signal is delayed considerably compared with the clock signal. Consequently, the timing of the data signal and the timing of the clock signal may possibly shift from each other (time difference may be generated).

However, according to the above arrangement, the stage numbers of the latch circuits in each block is set in such a manner to minimize the time difference between the pulse signal outputted from each block and the data signal outputted in sync with the pulse signal. Therefore, a satisfactory video can be displayed without unwanted blur or ghost caused by the time difference between the pulse signal and the data signal.

In addition to the above arrangement, it is preferable that the output circuit is arranged to include an analog switch for outputting the data signal inputted from the external, and that the shift register circuit is arranged in such a manner that the stage numbers of the latch circuits included in each block is monotonously increased with a distance from the signal input side.

According to the above arrangement, a load of the clock signal line in the remote block from the signal input section can be increased by increasing the stage numbers of the latch circuits included in each block monotonously with a distance from the signal input side.

Consequently, since a delay of the clock signal can be increased gradually with a distance from the signal input section, a delay difference between the clock signal and data signal in the last block, which is the remotest block from the signal input section, can be minimized.

Thus, in the dot sequential driving method, in which the output circuit includes the analog switch for outputting the data signal inputted from the external, a satisfactory video can be displayed without unwanted blur or ghost caused by the time difference between the pulse signal and the data signal lines.

In addition, in each of the above arrangements, the clock signal can be supplied to each block. However, it is preferable to provide a control section for controlling the supply of the clock signal to each block, so that each block has a supply period during which the clock signal is supplied and a non-supply period during which the clock signal is not supplied. However, the supply period is set to cover at least an interval during which any of the latch circuits in its own block transmits the pulse signal.

According to the above arrangement, no clock signal is supplied to each block during the non-supply period in a period while the pulse signal is not transmitted. Thus, the number of the latch circuits receiving the clock signal simultaneously can be reduced. Consequently, the power consumed for driving the internal clock signal lines connected to the input section inside the shift register circuit can be reduced significantly. Hence, the power consumption of the data signal line driving circuit can be reduced.

Here, the power consumption of the data signal line driving circuit can be reduced to some extent if the non-supply period is provided to each block regardless of the arrangement of the non-supply period. However, to reduce the power consumption, it is preferable to further arrange that the clock signal is selectively supplied only to the block including latch circuits near the latch circuit to which the pulse signal is transmitted, for example, a block including the latch circuit to which the pulse signal is transmitted and some latch circuits in the preceding stages. According to the above arrangement, the number of the latch circuits receiving the clock signal simultaneously can be minimized without causing any trouble in the shift register circuit. Consequently, the power consumption on the data signal line driving circuit can be reduced further.

Also, when the clock signal is selectively supplied, the supply period for each block may overlap or may be separated. However, when the supply period for each block do not overlap at all, either the rising or falling edge of the transmitted signal can not be transmitted. Thus, a generating circuit for generating the non-transmitted edge based on the transmitted other edge must be provided additionally, thereby upsizing the data signal line driving circuit.

Thus, it is more preferable to arrange that the control section controls the supply of the clock signal in such a manner that the clock signal is supplied selectively only to the block including latch circuits near the latch circuit to which the pulse signal is transmitted, and that the clock signals respectively inputted into the latch circuits in the adjacent blocks overlap for at least one clock.

According to the above arrangement, the control section supplies the clock signal selectively only to the block including the latch circuits near the latch circuit to which the pulse signal is transmitted, and that the clock signals respectively inputted into the latch circuits in the adjacent blocks overlap for at least one clock. Thus, the pulse signal can be transmitted normally between the adjacent blocks. Consequently, erroneous transmission of the pulse signal to the latch circuit can be eliminated without providing the generating circuit, thereby enabling the shift register circuit to operate normally and hence realizing satisfactory video display.

The clock signal may be supplied selectively from the external, but it is preferable to further arrange that a clock signal control circuit for outputting the clock signal to the latch circuits in the block of the shift register circuit for a certain period is provided to each block, and that the clock signal control circuit controls the output of the clock signal based on the output signal from the latch circuits in the preceding and next following blocks.

According to the above arrangement, an additional circuit for controlling the start and end of the output of the clock signal does not have to be provided, because the output of the clock signal is started using the output signal from the latch circuit in the preceding block to the selected block, and the output of the clock signal is stopped using the output signal of the latch circuit in the next following block of the selected block. More specifically, additional complex circuits, such as a shift register circuit, a counter circuit, and a decoder circuit, disclosed in aforementioned Japanese Examined Patent Publication No. 50717/1988 (Tokukousho No. 63-50717) are not necessary.

Consequently, there can be attained an effect that a circuit added to the data signal line driving circuit can be very small.

Moreover, since a control signal for selecting the block is generated inside the data signal line driving circuit, an external terminal for receiving the control signal for selecting the block can be omitted, thereby simplifying the circuit arrangement.

It is further preferable to arrange the clock signal control circuit in such a manner that the output of the clock signal is started based on the output signal from the latch circuit at or before the last stage in the preceding block, and the output of the clock signal is stopped based on the output signal of the latch circuit at or after the second stage in the next following block.

According to the above arrangement, the clock signal control circuit starts the output of the clock signal based on the output signal from the latch circuit at or before the last stage in the preceding block, and stops the output of the clock signal based on the output signal of the latch circuit at or after the second stage in the next following block. Consequently, the number of the latch circuits to which the clock signal is supplied can be minimized without causing any malfunction.

In addition, in case that the clock signal is selectively supplied in the above arrangement, it is preferable to further arrange the clock signal control circuit in such a manner to output a constant bias to the latch circuits while the clock signal is not supplied to the same.

According to the above arrangement, a constant bias is applied to the clock signal lines to which the clock signals are not supplied. Thus, the potential level of the internal node can remain the same against the noises or the like. Consequently, each latch circuit can be maintained in a stable manner, thereby preventing the malfunction of the latch circuit and eliminating the output of an error signal.

The data signal line driving circuit may be further arranged in such a manner that it is composed of a polycrystalline silicon thin film transistor.

According to the above arrangement, since the data signal line driving circuit is composed of a polycrystalline silicon thin film transistor, a highly reliable circuit element which achieves a significant power consumption reducing effect can be obtained.

To be more specific, the data signal line driving circuit composed of the polycrystalline silicon thin film transistor is larger than its counterpart composed of a monocrystal silicon thin film transistor having substantially the same performance, and thereby demands a higher driving voltage. However, since the above-arranged data signal line driving circuit consumes less power compared with the conventional data signal line driving circuit, an overall power consumption of the data signal line driving circuit can be suppressed regardless of the use of the polycrystalline silicon thin film transistor.

Here, the above-arranged data signal line driving circuit can reduce the time difference between the data signal and the pulse signal when sequentially outputting the data signals to the individual data signal lines based on the pulse signal generated in sync with the clock signal. Thus, for example, the above-arranged data signal line driving circuit can be suitably applied particularly to a circuit having a large number of data signal lines and therefore the data signal is readily delayed. An example of such a circuit is an image forming apparatus.

In other words, an image forming apparatus of the present invention comprises:

a matrix of pixels;

a plurality of data signal lines for supplying a video signal to be written into the pixels; and a plurality of scanning signal lines for supplying control signals for controlling writing action of video data into the pixels, and the above image display apparatus is characterized in that the data signal line driving circuit arranged in any of the above-mentioned manners is used as a data signal line driving circuit for outputting a video signal to the data signal lines in sync with the clock signal.

According to the above arrangement, the data signal line driving circuit arranged in any of the above-mentioned manners is used as a data signal line driving circuit for outputting a video signal to the data signal lines in sync with the clock signal. Thus, the time difference between the clock signal outputted from the shift register circuit and the data signal inputted into the output circuit in the data signal line driving circuit can be reduced.

Consequently, a satisfactory video can be displayed without unwanted blur or ghost caused by the time difference between the clock signal and the data signal. Moreover, since the clock signal is supplied per block unit, the least power is consumed by each clock signal. Thus, it has become possible to reduce an overall power consumption of the image display apparatus.

In addition to the above arrangement, it is further preferable to arrange that the data signal line driving circuit is formed on the substrate, on which the pixels are also formed.

According to the above arrangement, at least the data signal line driving circuit and pixels are formed on the same substrate. Then, both the driving circuits can be formed in a single step where the pixels are formed.

Consequently, the packaging costs of the driving circuit can be saved while the reliability is increased. In other words, when the driving circuit and pixels are formed separately, a process for connecting the driving circuit to the pixels is indispensable, and connection deficiency occurs during this process, thereby deteriorating the reliability. However, this process can be omitted by forming the data signal line driving circuit and pixels in a single step in the same process. Consequently, it has become possible to eliminate the connection deficiency caused during the connecting process of the data signal line driving circuit to the pixels, while increasing the reliability of the circuit.

Moreover, since the data signal line driving circuit and pixels can be formed on the same substrate in the same process, the packaging costs of the driving circuits can be saved while the reliability is increased.

The above arranged image display apparatus may be composed of a polycrystalline thin film transistor formed over a glass substrate at a process temperature of 600° C. or below.

According to the above arrangement, the polycrystalline silicon thin film transistor can be formed at the process temperature of 600° C. or below, which is the distorting point of glass. Then, the polycrystalline silicon thin film transistor can be formed over a large inexpensive glass substrate. As a consequence, a large-scale image forming apparatus can be formed over an inexpensive substrate, thereby making it possible to provide an inexpensive image forming apparatus with a large-scale screen.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A data signal line driving circuit comprising:

a shift register circuit for sequentially transmitting a pulse signal in sync with a clock signal, said shift register circuit being composed of a plurality of serially connected latch circuits; and an output circuit for sequentially outputting data signals to data signal lines in sync with output signals outputted from said shift register circuit, wherein, said shift register circuit is divided into a plurality of blocks, each block including a number of stages (stage numbers) of latch circuits, where all the blocks have not-identical number of stages of the latch circuits, while some of the blocks may have an identical number of stages of the latch circuits with each other, and stage numbers of the latch circuits included in said each block is set so as to compensate for a difference between the differing delays of the sequential output signals and the differing delays of the data signals.

2. A data signal line driving circuit comprising:

a shift register circuit for sequentially transmitting a pulse signal in sync with a clock signal, said shift register circuit being composed of a plurality of serially connected latch circuits;

an output circuit for sequentially outputting data signals to data signal lines in sync with output signals outputted from said shift register circuit; and wherein:

said shift register circuit is divided into a plurality of blocks, each block including a number of stages (stage numbers) of latch circuits, where all the blocks have a different number of stages of the latch circuits, stage numbers of the latch circuits included in said each block is set so as to compensate for a difference between the differing delays of the sequential output signals and the differing delays of the data signals, said output circuit includes an analog switch for outputting the data signal inputted from an external, and said shift register circuit is arranged in such a manner that the stage numbers of the latch circuits included in said each block is monotonously increased with a distance from a signal input side.

3. A data signal line driving circuit comprising:

a shift register circuit for sequentially transmitting a pulse signal in sync with a clock signal, said shift register circuit being composed of a plurality of serially connected latch circuits;

an output circuit for sequentially outputting data signals to data signal lines in sync with output signals outputted from said shift register circuit;

wherein said shift register circuit is divided into a plurality of blocks, each block including a number of stages (stage numbers) of latch circuits, where ail the blocks have a different number of stages of the latch circuits;

wherein stage numbers of the latch circuits included in said each block is set so as to compensate for a difference between the differing delays of the sequential output signals and the differing delays of the data signals; and a control section for supplying the clock signal to the block during a supply period covering at least an interval during which any of the latch circuits included in said block transmits the pulse signal, and for stopping the supply of the clock signal to said block during a non-supply period.

4. The data signal line driving circuit of claim 3, wherein, when the pulse signal is to be transmitted from one block to another block, said control section supplies the clock signal to both blocks, and when the pulse signal is transmitted throughout one block, said control section supplies the clock signal to said one block alone.

5. The data signal line driving circuit of claim 3, wherein said control section supplies the clock signal to a block including a particular latch circuit to which the pulse signal is to be transmitted next and the latch circuits at some stages before said particular latch circuit.

6. The data signal line driving circuit of claim 3, wherein said control section controls an output of the clock signal so that the clock signals respectively inputted into the latch circuits in adjacent blocks overlap for a period at least as long as a pulse width of the pulse signal.

7. The data signal line driving circuit of claim 3, wherein:

a clock signal control section is provided to said control section for each block of said shift register circuit to output the clock signal to each latch circuit in the block during the supply period; and said each clock signal control circuit controls an output of the clock signal based on an output signal from the latch circuits in a preceding block and a next following block.

8. The data signal line driving circuit of claim 7, wherein said each clock signal control circuit starts an output of the clock signal based on an output signal from the latch circuit at or before a last stage in the preceding block, and said clock signal control circuit stops the output of the clock signal based on an output signal from the latch circuit at or after a second stage in the next following block.

9. The data signal line driving circuit of claim 3, wherein, when the block is in the non-supply period, said control section outputs a constant bias to each latch circuit in the block.

10. The data signal line driving circuit of claim 1, wherein said data signal line driving circuit is composed of a polycrystalline silicon thin film transistor.

11. An image display apparatus comprising:

a matrix of pixels;

a plurality of data signal lines for supplying a video signal to be written into the pixels;

a plurality of scanning signal lines for supplying a control signal for controlling a writing action of video data into the pixels; and a data signal line driving circuit for outputting the video signal to the data signal lines in sync with a clock signal, said data signal line driving circuit comprising:

a shift register circuit for sequentially transmitting a pulse signal in sync with a clock signal, said shift register circuit being composed of a plurality of serially connected latch circuits; and an output circuit for sequentially outputting said video signal as a data signal to each data signal line in sync with an output signal outputted from said shift register circuits, wherein:

said shift register circuit is divided into a plurality of blocks, each block including a number of stages (stage numbers) of latch circuits, where all the blocks have a different number of stages of the latch circuits, stage numbers of the latch circuits included in said each block is set so as to compensate for a difference between the differing delays of the sequential output signals and the differing delays of the data signals, said output circuit includes an analog switch for outputting the data signal inputted from an external, and said shift register circuit is arranged in such a manner that the stage numbers of the latch circuits included in said each block is monotonously increased with a distance from a signal input side.

12. An image display apparatus comprising:

a matrix of pixels;

a plurality of data signal lines for supplying a video signal to be written into the pixels;

a plurality of scanning signal lines for supplying a control signal for controlling a writing action of video data into the pixels; and a data signal line driving circuit for outputting the video signal to the data signal lines in sync with a clock signal, said data signal line driving circuit comprising:

a shift register circuit for sequentially transmitting a pulse signal in sync with a clock signal, said shift register circuit being composed of a plurality of serially connected latch circuits;

an output circuit for sequentially outputting said video signal as a data signal to each data signal line in sync with an output signal outputted from said shift register circuits;

wherein said shift register circuit is divided into a plurality of blocks, each block including a number of stages (stage numbers) of latch circuits, where all the blocks have a different number of stages of the latch circuits, and stage numbers of the latch circuits included in said each block is set so as to compensate for a difference between the differing delays of the sequential output signals and the differing delays of the data signals; and a control section for supplying the clock signal to the block during a supply period covering at least an interval during which any of the latch circuits included in said block transmits the pulse signal, and for stopping the supply of the clock signal to said block during a non-supply period.

13. The image display apparatus of claim 12, wherein, when the pulse signal is to be transmitted from one block to another block, said control section supplies the clock signal to both blocks, and when the pulse signal is transmitted throughout one block, said control section supplies the clock signal to said one block alone.

14. The image display apparatus of claim 12, wherein said control section supplies the clock signal to a block including a particular latch circuit to which the pulse signal is to be transmitted next and the latch circuits at some stages before said particular latch circuit.

15. The image display apparatus of claim 12, wherein said control section controls an output of the clock signal so that the clock signals respectively inputted into the latch circuits in adjacent blocks overlap for a period at least as long as a pulse width of the pulse signal.

16. The image display apparatus of claim 12, wherein:

a clock signal control section is provided to said control section for each block of said shift register circuit to output the clock signal to each latch circuit in the block during the supply period; and said each clock signal control circuit controls an output of the clock signal based on an output signal from the latch circuits in a preceding block and a next following block.

17. The image display apparatus of claim 16, wherein said each clock signal control circuit starts an output of the clock signal based on an output signal from the latch circuit at or before a last stage in the preceding block, and said clock signal control circuit stops the output of the clock signal based on an output signal from the latch circuit at or after a second stage in the next following block.

18. The image display apparatus of claim 12, wherein, when the block is in the non-supply period, said control section outputs a constant bias to each latch circuit in the block.

19. The image display apparatus of claim 12, wherein said data signal line driving circuit is composed of a polycrystalline silicon thin film transistor.

20. The image display apparatus of claim 12, wherein at least said data signal line driving circuit is formed on a substrate on which the pixels are also formed.

21. The image display apparatus of claim 20, wherein each of said data signal line driving circuit and pixels is composed of a polycrystalline silicon thin film transistor formed over a glass substrate through a process carried out at 600° C. or below.

* * * * *